US007780006B2

(12) United States Patent
Clark, Jr. et al.

(10) Patent No.: US 7,780,006 B2
(45) Date of Patent: Aug. 24, 2010

(54) FLEXIBLE PACKAGE WITH OPENING FEATURE

(75) Inventors: James J. Clark, Jr., Appleton, WI (US); Deborah S. Hannah, Appleton, WI (US); James R. Marnocha, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1273 days.

(21) Appl. No.: 11/323,628

(22) Filed: Dec. 30, 2005

(65) Prior Publication Data

US 2007/0151887 A1 Jul. 5, 2007

(51) Int. Cl.
*B65D 73/00* (2006.01)

(52) U.S. Cl. ..... 206/494; 206/812

(58) Field of Classification Search ..... 206/494, 206/823, 233, 210, 581, 812; 229/87.05
See application file for complete search history.

(56) References Cited

U.S. PATENT DOCUMENTS

| | | | | |
|---|---|---|---|---|
| 3,228,584 | A | 1/1966 | Ashton | |
| 4,308,679 | A * | 1/1982 | Ray et al. | 40/312 |
| 4,345,393 | A * | 8/1982 | Price et al. | 40/312 |
| 4,574,952 | A * | 3/1986 | Masui | 206/494 |
| 4,779,733 | A * | 10/1988 | Kilian | 206/459.5 |
| 5,242,057 | A * | 9/1993 | Cook et al. | 206/581 |
| 6,026,953 | A * | 2/2000 | Nakamura et al. | 206/233 |
| 6,095,326 | A * | 8/2000 | Madhat et al. | 206/233 |
| 6,446,796 | B1 | 9/2002 | Schmidt | |
| 2002/0017469 | A1 * | 2/2002 | Snedeker et al. | 206/233 |
| 2002/0175094 | A1 * | 11/2002 | Campbell et al. | 206/233 |
| 2003/0168467 | A1 | 9/2003 | Thoms | |
| 2004/0089578 | A1 * | 5/2004 | Lin | 206/494 |

FOREIGN PATENT DOCUMENTS

DE 202004007773 U1 7/2004

OTHER PUBLICATIONS

International Search Report for PCT/US2006/042049 dated Feb. 21, 2007, 6 pages.

* cited by examiner

*Primary Examiner*—Jacob K Ackun, Jr.
(74) *Attorney, Agent, or Firm*—Armstrong Teasdale, LLP

(57) ABSTRACT

A flexible package has a top surface, a bottom surface and at least one side wall together defining an interior volume of the package. An opening device is attached to the top surface and is at least in part detachable from the top surface to provide access to the interior volume. An article is secured to the opening device for conjoint movement with the opening device upon detachment of the opening device from the top surface of the package. In another embodiment, a portion of the side wall extends outward beyond the top surface to a free edge. A closure system is operable on the extended portion of the side wall to permit selective closing and opening of the package.

15 Claims, 19 Drawing Sheets

FLEXIBLE PACKAGE WITH OPENING FEATURE

FIELD OF THE INVENTION

The present invention relates to a flexible package for containing and dispensing articles. More particularly, the present invention relates to a flexible packaging bag having an opening feature that provides for easy access to the contents of the bag.

BACKGROUND

Packaging bags made from flexible polymeric materials have been used for packaging various types of products, including, for example, adult incontinence articles, diapers, training pants, feminine care products, among many other items. These bags provide packaging for the products, creating a carton-like look and configuration which facilitates display of the products on the retail shelf for consumers to purchase. These bags also provide a convenient way for the consumer to transport the products from the retailer to the consumer's home or place of use. Typically, these bags are provided with an opening device that allows the consumer to access products contained within the bags.

Currently available opening devices often compromise the structure of the bag, causing the bag to fully or partially collapse on itself and any product remaining in the bag as the products are removed. This can make it difficult for the consumer to remove remaining product from the bag. Further, when the bag collapses, the bag loses its carton-like structure, which is often considered by consumers to lack neatness. On other currently available bags, the opening device is not of a sufficient size to easily access and remove the products from the bag. If the opening device is not of a sufficient size, then extra effort may be required from a consumer to remove the product from the bag. In addition, many currently available bag opening devices are difficult for consumers to open for one reason or another. For example, many opening devices have a pinch and pull opening means in which the user must grasp and pinch the packaging bag on opposite sides of an opening seam and pull outward to open the bag at the seam. It is widely recognized that such grasping or pinching of a packaging bag to open the bag can be difficult for older users and those users with diseases which affect the dexterity of a user's hands, such as arthritis.

To avoid the problems described above, there is a need in the art for a flexible packaging bag which retains its shape after opening and provides easy access to the articles stored inside the bag to facilitate easy removal of the articles from the bag. In addition, there is a need in the art for a flexible packaging bag which is easy for consumers to open, particularly for consumers who have difficulty in grasping or pinching materials such as polymer films. There is also a need for such a flexible packaging bag that is capable of repeated opening and closing.

SUMMARY

In general, a flexible package according to one embodiment comprises a top surface, a bottom surface spaced from the top surface, and at least one side wall. The top surface and the bottom surface are each connected to the at least one side wall such that the top surface, the bottom surface and the at least one side wall together define an interior volume of the package for containing at least one article therein. The top surface has a length, a width, and a peripheral edge defined at least in part by the connection of the top surface to the at least one side wall. An opening device is attached to the top surface and is at least in part detachable from the top surface to provide access to the interior volume of the package. The opening device has a length of greater than zero and less than the length of the top surface and further has a width of greater than zero and less than the width of the top surface. An article is secured to the opening device for conjoint movement with the opening device relative to the top surface upon detachment of the opening device from the top surface of the package.

In another embodiment, a flexible package generally comprises a top surface, a bottom surface spaced from the top surface, and at least one side wall. The top surface and the bottom surface are each connected to the at least one side wall such that the top surface, the bottom surface and the at least one side wall together define an interior volume of the package for containing at least one article therein. The top surface has a length, a width, and a peripheral edge defined at least in part by the connection of the top surface to the at least one side wall. The top surface further has an opening therein in spaced relationship with the peripheral edge of the top surface. A covering device for the opening is secured to the top surface of the package and is at least in part separable from the top surface to permit access to the interior volume of the package via the opening in the top surface. The covering device has a length of greater than zero and less than the length of the top surface and further has a width of greater than zero and less than the width of the top surface. An article is secured to the covering device for conjoint movement with the covering device relative to the top surface of the package upon separation of the covering device from the top surface.

A flexible package according to another embodiment generally comprises a top surface, a bottom surface spaced from the top surface, and at least one side wall. The top surface and the bottom surface are each connected to the at least one side wall such that the top surface, the bottom surface and the at least one side wall together define an interior volume of the package for containing at least one article therein. The top surface has a length, a width, and a peripheral edge defined at least in part by the connection of the top surface to the at least one side wall. An opening device is attached to the top surface and is at least in part detachable from the top surface to provide access to the interior volume of the package. The opening device has a width at some point along the length of the opening device which is between about 40% and about 99% of the width of the top surface and a length at some point along the width of the opening device which is between about 40% and about 99% of the length of the top surface. At least one drawstring is provided for drawing in the at least one side wall of the package to selectively close access to the interior volume of the package following detachment of the opening device from the top surface of the package.

In yet another embodiment, a flexible package generally comprises a top surface, a bottom surface spaced from the top surface, and at least one side wall. The top surface and the bottom surface are each connected to the at least one side wall such that the top surface, the bottom surface and the at least one side wall together define an interior volume of the package for containing at least one article therein. The top surface has a length, a width, and a peripheral edge defined at least in part by the connection of the top surface to the at least one side wall. A portion of the at least one sidewall extends outward beyond the connection of the top surface to the at least one side wall and has a free edge spaced from the connection of the top surface to the at least one side wall. An opening device is attached to the top surface of the package and is at least in part detachable from the top surface to provide access to the interior volume of the package. The opening device has a width at some point along the length of the opening device which is between about 40% and about 99% of the width of the top surface and a length at some point along the width of the opening device which is between about 40% and about 99% of the length of the top surface. A closure system is operable on the extended portion of the at least one side wall to permit selective closing and opening of the package following detachment of the opening device from the top surface of the package.

In still another embodiment, a flexible package generally comprises a top surface, a bottom surface spaced from the top surface, and at least one side wall. The top surface and the bottom surface are each connected to the at least one side wall such that the top surface, the bottom surface and the at least one side wall together define an interior volume of the package for containing at least one article therein. The top surface has a length, a width, and a peripheral edge margin defined at least in part by the connection of the top surface to the at least one side wall. The top surface further has a first opening therein in spaced relationship with the peripheral edge of the top surface, with the opening having a width at some point along a length of the opening between about 40% and about 99% of the width of the top surface and a length at some point along the width of the opening between about 40% and about 99% of the length of the top surface. A portion of the at least one side wall extends outward beyond the connection of the top surface to the at least one side wall and has a free edge spaced from the connection of the top surface to the at least one side wall. The free edge at least in part defines a second opening of the package spaced from the first opening in the top surface of the package. A covering device for the first opening is secured to the top surface of the package and is at least in part separable from the top surface to permit access to the interior volume of the package via the first opening in the top surface. A closure system is operable on the extended portion of the at least one side wall to permit selective configuration of the extended portion between an open configuration in which the second opening is at least as large as the first opening in the top surface of the package and a closed configuration in which the second opening is substantially smaller than the first opening in the top surface of the package.

BRIEF DESCRIPTION OF THE DRAWINGS

Corresponding reference characters indicate corresponding parts throughout the drawings.

DEFINITIONS

Figure 1:
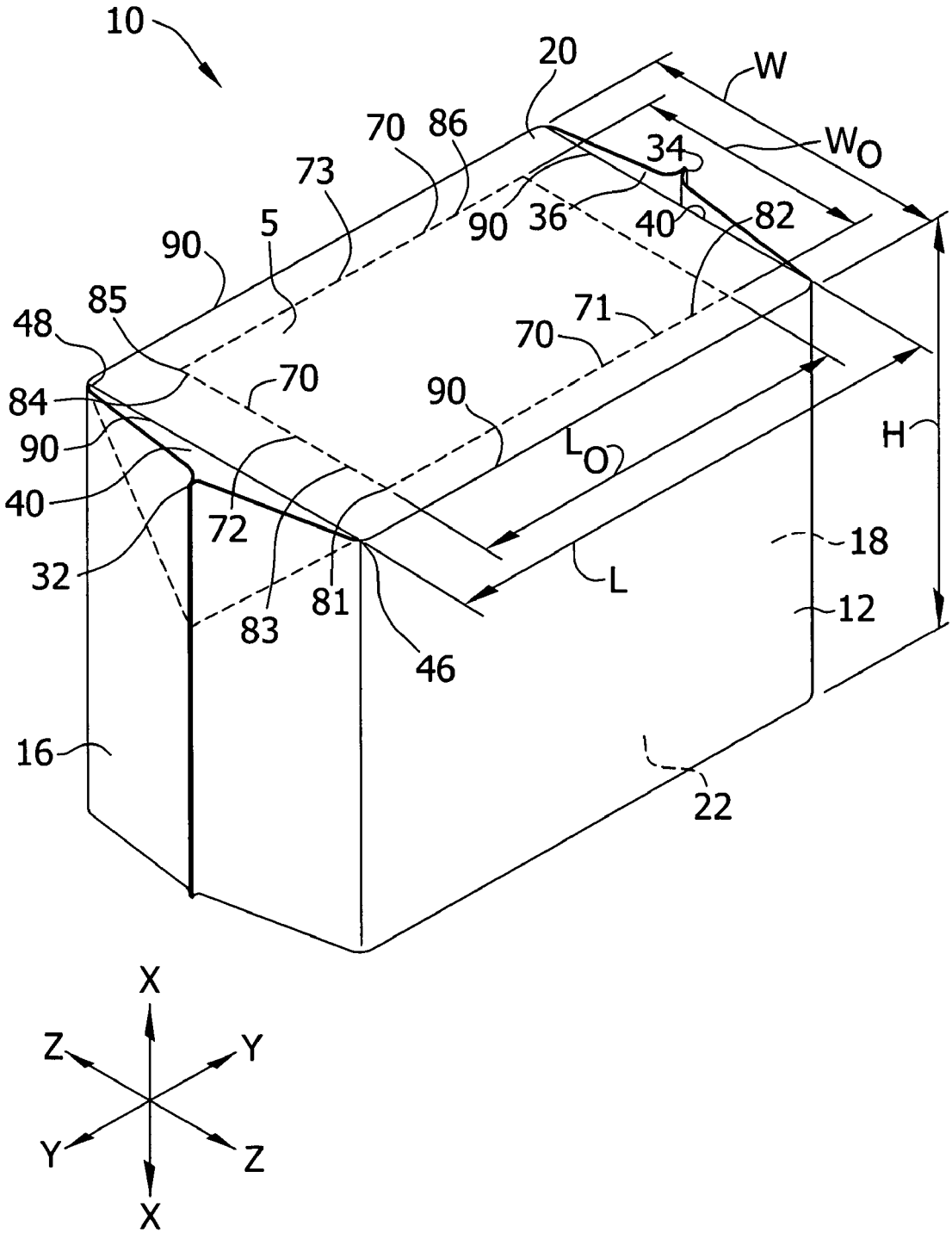
FIG. 1 shows a perspective view of a flexible package of the present invention having an opening device in an unopened state.

It should be noted that, when employed in the present disclosure, the terms "comprises", "comprising" and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

The term "line of weakness" as used herein, refers to any region or area of weakened material, preferably having a length, but not necessarily a defined width. A "line of weakness" can include linear and non-linear patterns, such as curvilinear patterns of weakness, or other shapes, such as circles, rectangles, and so forth. A line of weakness includes a perforation or other series of cuts, a thinning or breakage or separation of material, or a strip of a different kind of material bridging between adjacent portions of material that is more easily torn or broken than the adjacent portions, and which allows the user or manufacturer to separate the adjacent portions along the line of weakness. A line of weakness can further include a single extended slit or cut.

As used herein, the terminology such as "vertical", "horizontal", "top", "bottom", "front", "back", "end" and "sides" are referenced according to the views presented. It should be understood, however, that the terms are used only for purposes of description, and are not intended to be used as limitations. Accordingly, orientation of an object or a combination of objects may change without departing from the scope of the invention. As a point of reference for the claims and in the present specification, the term "top" refers to a panel or side of the package with an opening device or opening.

As used herein, the term "opening device" refers to the area of the package which can be manipulated by a user to access any articles contained within the flexible package. The opening device may be removable from the package or may remain attached to the package after the opening device is opened. The opening device may be a part of the top surface or a separate material attached to the top surface.

As used herein, the term "opening" refers to a removed or otherwise cut-away portion of the flexible package which allows access to the articles contained within the interior compartment and allows for the articles to be removed from the interior compartment.

It should be understood that the terms "personal care product" or "personal care article" as used herein refers to any article used to control bodily fluids, and includes "absorbent products," or "absorbent articles" which refers to any article configured to absorb and retain bodily exudates, including urine, bowel movements, blood and menses, and includes such a product in a packaged and unpackaged configuration. As such, personal care products, as used herein, includes without limitation, diapers, child toilet training pants, adult incontinence garments, male incontinence products, tampons, vaginal suppositories, pantiliners, pads, sanitary napkins, tissues, wipes, etc. Examples of commercially available personal care products include, without limitation, Poise® feminine care products, including pantiliners and pads, and Kotex® feminine care products, including pads, tampons and liners, all available from Kimberly-Clark Corporation, Neenah, Wis.

As used herein, the term "shape retaining" is intended to mean that the shape of the flexible package with articles contained therein is essentially the same as the shape of the package while the articles are being removed and with all of the articles removed from the interior compartment of the package. That is the sides of the package do not tend to fall inward towards the interior compartment or outward away from the interior compartment and the top surface does not fall inward towards the interior compartment. It is noted that a small degree, i.e., less than about a 20% variation in width and/or length of the top surface, comparing the length or width of the top surface while the package is full to the length or width of the top surface with the articles removed, is considered to be shape retaining. For example, for a package having a width of 10 cm at the top surface with the articles contained therein, if the package has a width at the same point of 8-12 cm after the articles are removed, the package is considered to be shape retaining.

As used herein, the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configuration of the material. These configurations include, but are not limited to isotactic, syndiotactic and random symmetries.

DETAILED DESCRIPTION

In the following detailed description, reference is made to the accompanying drawings which form a part hereof, and in which is shown by way of illustration specific embodiments in which the inventions may be practiced. These embodiments are described in sufficient detail to enable those skilled in the art to practice the invention, and it is to be understood that other embodiments may be utilized and that mechanical, procedural, and other changes may be made without departing from the spirit and scope of the present invention. The following detailed description is, therefore, not to be taken in a limiting sense, and the scope of the present invention is defined only by the appended claims, along with the full scope of equivalents to which such claims are entitled.

Figure 2:
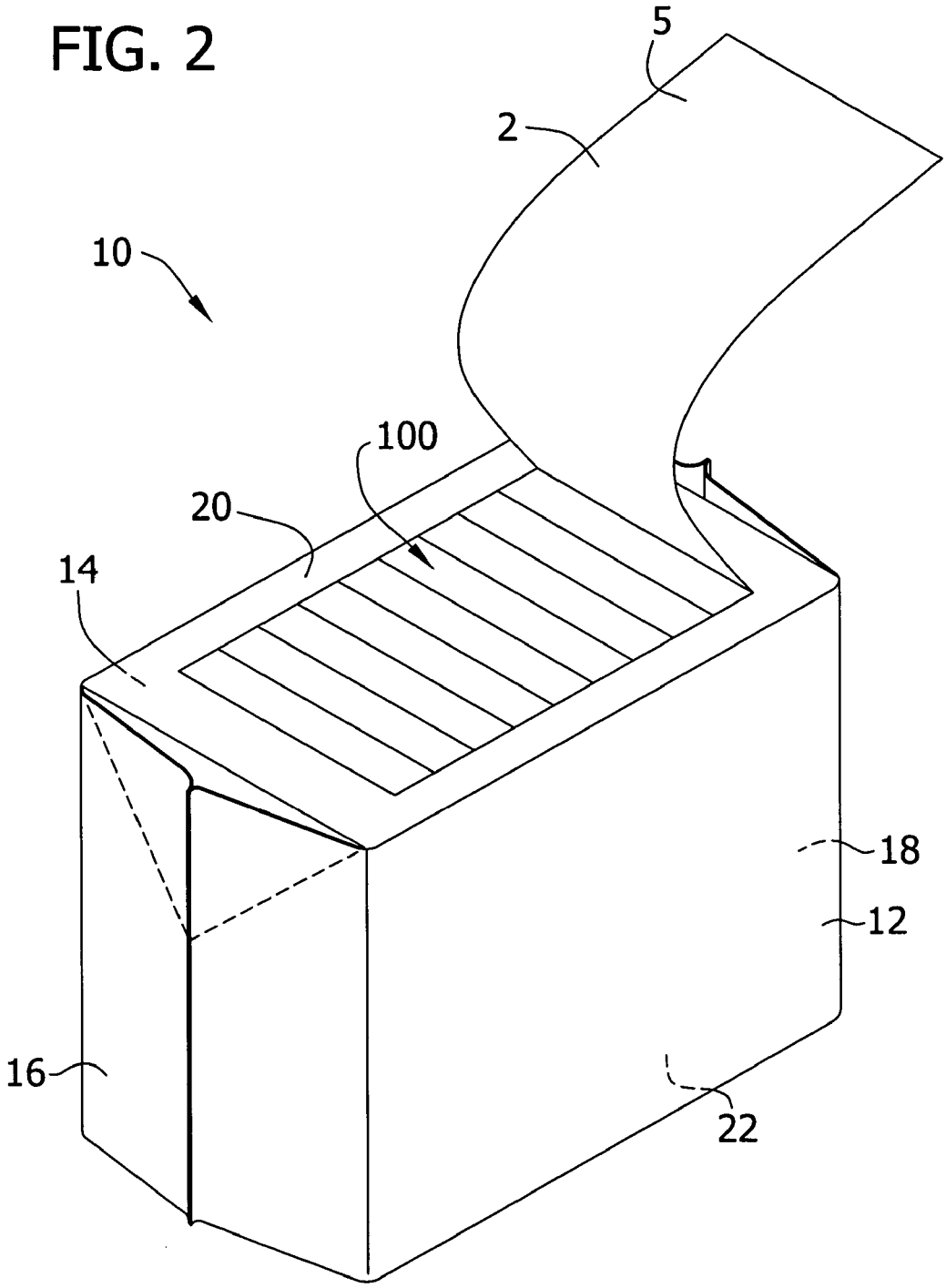
FIG. 2 shows a perspective view of a flexible package of the present invention having an opening device in an opened state revealing the articles within the flexible package.
Figure 3:
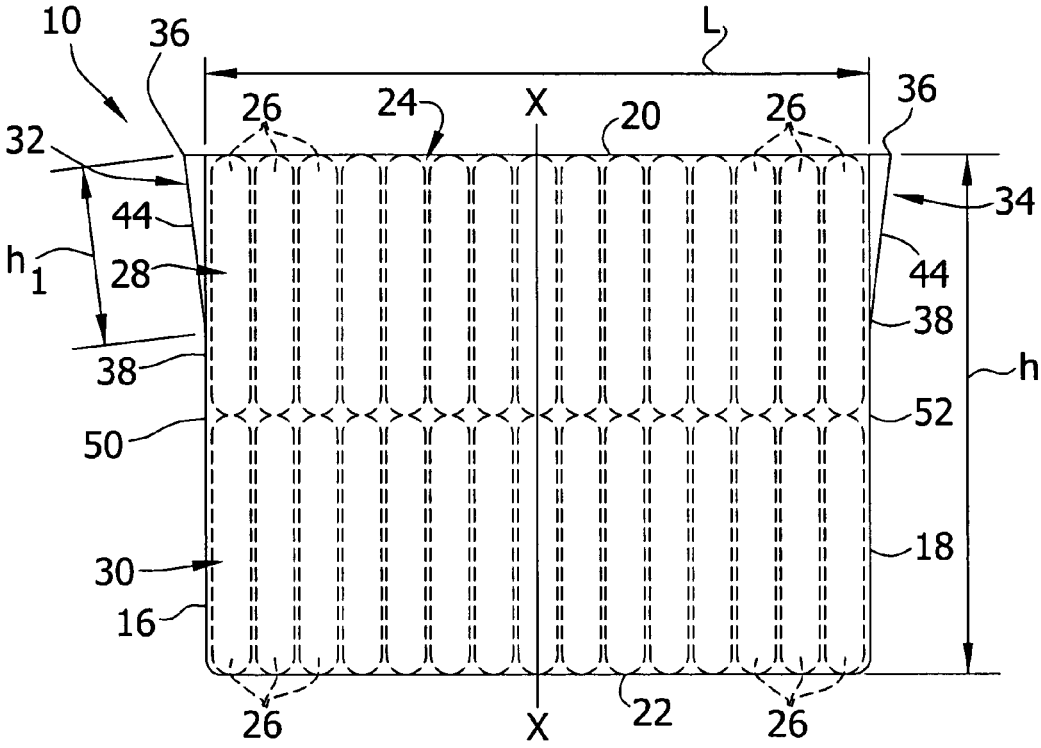
FIG. 3 shows a plane front view of a flexible package of the present invention depicting two horizontal rows of articles stacked within the package.

With particular reference to the drawings and in particular FIGS. 1-3, a flexible package 10 according to one embodiment has an opening device 5 for use in opening the package to gain access to the contents of the package. As illustrated in FIGS. 1 and 2, the flexible package has a top surface 20, a bottom surface 22, a front wall 12, a back wall 14, and a first side wall 16 and a second side wall 18. The first side wall 16 and the second side wall 18 are opposed to each other; as are the front wall 12 and the back wall 14, and the top surface 20 and the bottom surface 22. As shown, the front wall 12, the back wall 14, the two side walls 16 and 18, the top surface 20 and the bottom surface 22 are directly or indirectly connected together to form the package 10 which has an interior compartment 24 with an interior volume. The interior compartment 24 is capable of containing a plurality of articles 26. The package 10 has a longitudinal axis Y-Y, a transverse axis Z-Z and a vertical axis X-X. The package also has a height H, a width (depth) W and a length L. As is shown in FIGS. 1 and 2, the flexible package has four side walls. It is not outside the present invention that the flexible package has a single side wall which is continuous, two side walls, three side walls or more than four side walls. It is noted that in a common configuration, the flexible package has four side walls and for purposes of understanding the present invention only, the flexible package will be described in terms of a flexible package having four side walls.

The package 10 has an opening device 5 located on the top surface 20. The opening device 5 is formed from at least one line of weakness 70 on the top surface 20. This line of weakness 70 is confined to the top surface 20 such that there is a portion of the top surface located between the opening device 5 and an edge 90 created by the direct or indirect connection of the top surface 20 to the at least one side wall. Stated another way, the opening device 5 does not extend beyond the top surface 20 to any of the side walls. In addition, the opening device has a width Wo at a widest point along the length Lo of the opening device which is between about 40% and about 99% of the width W of the top surface 20.

Further, the opening device has a length Lo at a longest point along the width Wo of the opening device which is between about 40% and about 99% of the length L of the top surface 20. If the width of the opening device Wo at its widest point is less than about 40% of the width W of the top surface 20 or the length of the opening device Lo at its longest point is less than about 40% of the length L of the top surface, it can be difficult to remove the articles contained within the interior compartment 24. On the other hand, if the width of the opening device Wo is greater than about 99% of the width W of the top surface or the length of the opening device Lo is greater than about 99% of the length L of the top surface, the package will tend not to retain its shape, making the package appear being untidy to a consumer. When the flexible package does not retain its shape, it can be difficult to remove an article 26 from the interior compartment 24, since the package may collapse on itself and any articles 26 contained within the interior compartment 24.

In one embodiment, the opening device has a width Wo at its widest point along the length Lo of the opening device which is between about 50% and about 90% of the width W of the top surface. Suitably, the width Wo at its widest point along the length Lo of the opening device is between about 60% and about 80% of the width W of the top surface. In a similar manner, the opening device has a length Lo at its longest point along the width Wo of the opening device is between about 50% and about 90% of the length L of the top surface. Suitably, the length Lo at its widest point along the width Wo of the opening device that is between about 60% and about 80% of the length L of the top surface. The opening device 5, when opened, forms an opening 100 in the top surface which allows a consumer to access the articles 26 within the interior compartment 24 of the flexible package.

In the present invention, the width W and length L of the top surface 20 are measured as follows. The width W is the widest distance between the front wall 12 and the back wall 14 measured along the transverse axis Z-Z. In a similar manner, the length L of the top surface is the longest distance between the first side wall 16 and the second side wall 18, measured along the longitudinal axis Y-Y. Generally, the widest distance will occur near a midpoint of the top surface 20 along the length L or at the ends of the length L near the first and/or second sides. Similarly, the longest distance will generally occur near a midpoint of the top surface 20 along the width W or at the ends of the width W, near the front and/or back wall.

The line of weakness 70 which defines the opening device can be formed by any means, which will facilitate separation of the opening device 5 from the top surface 20 along the lines of weakness. An example of a line of weakness includes, without limitation, a perforated line, a line formed by a plurality of openings, such as slots separated by a plurality of land areas, a line of reduced material thickness, a weakened line formed by joining two sections of material together, or any other structural configuration known to those skilled in the art. Each of these lines of weakness are known to those skilled in the art and can be formed by known methods including, for example, mechanical treating of the package material, such as forming perforations in the package material.

Figure 9:
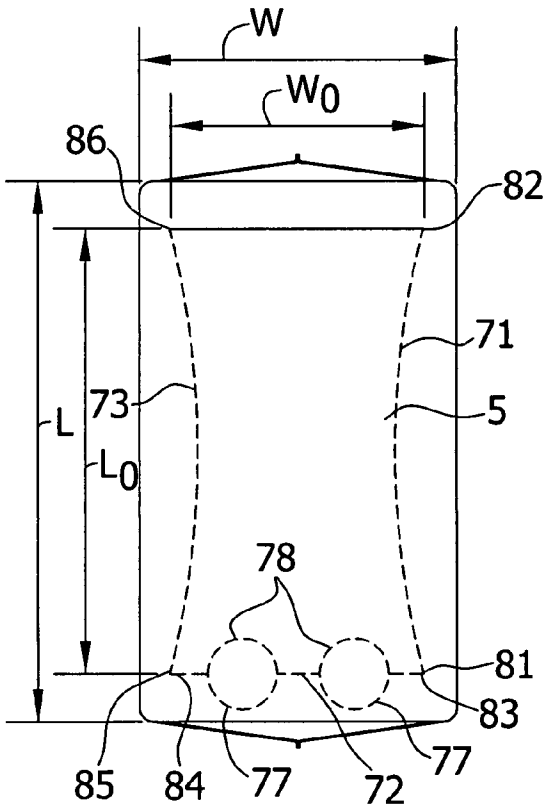
FIG. 9 shows a top view of the flexible package of the present invention with an opening device configuration with an alternative opening aid.
Figure 10:
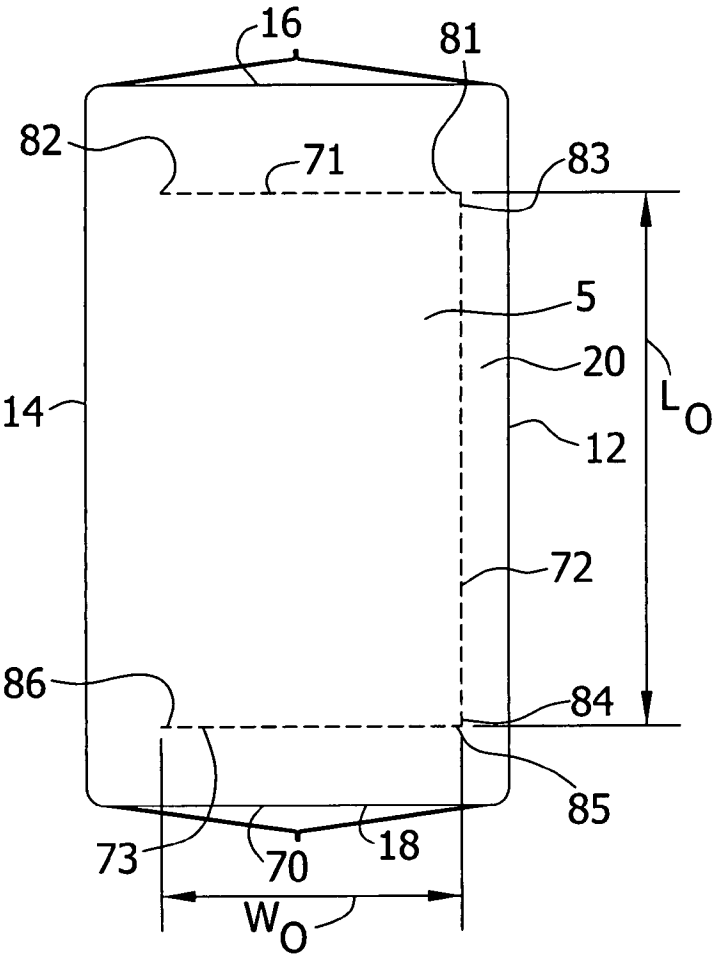
FIG. 10 shows a top view of the flexible package of the present invention with an alternative opening device configuration.

Referring to FIGS. 1, 2, 5, 6, 7, 8, 9, 10 and 11, different configurations of the opening device 5 are illustrated. In FIGS. 9 and 10, the opening device 5 has three lines of weakness 70, including the first line of weakness 71, the second line of weakness 72 and the third line of weakness 73. The first line of weakness 71 has a first end 81 and a second end 82, the second line of weakness 72, has a first end 83 and a second end 84, and the third line of weakness 73 has a first end 85 and a second end 86. The first end 81 of the first line of weakness 71 is adjacent the first end 83 of the second line of weakness 72, and the second end 84 of the second line of weakness 72 is adjacent the first end 85 of the third line of weakness 73. In the configuration shown in FIG. 10, the first line of weakness 71 is parallel to the third line of weakness 73 and the second line of weakness 72 is perpendicular to both the first and third lines of weakness 71 and 73. In the configuration shown in FIG. 9, the first and third lines of weakness 71 and 73 are non-linear, while the second line of weakness 72 is linear. In addition, in the configurations of FIGS. 9 and 10, the opening device 5 remains connected or attached to the flexible package 10 after opening, as is illustrated in FIG. 2.

Figure 6:
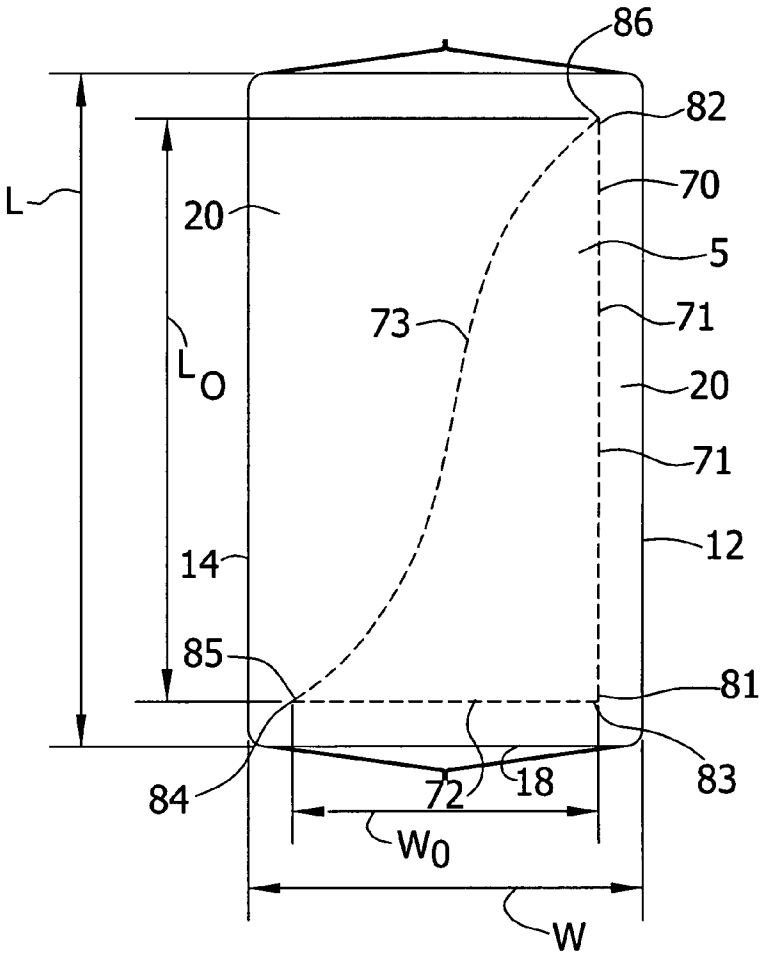
FIG. 6 shows a top view of the flexible package of the present invention with an alternative opening device configuration.

In the embodiment of FIG. 6, the opening device 5 has three lines of weakness 70, wherein one of the lines of weakness is non-linear and two are linear, the lines of weakness including a first line of weakness 71, a second line of weakness 72 and a third line of weakness 73. The first line of weakness 71 has a first end 81 and a second end 82, the second line of weakness 72, has a first end 83 and a second end 84, and the third line of weakness has a first end 85 and a second end 86. The first end 81 of the first line of weakness 71 is adjacent the first end 83 of the second line of weakness 72, the second end 84 of the second line of weakness 72 is adjacent the first end 85 of the third line of weakness 73, and the second end 81 of the first line of weakness is adjacent the second end 86 of the third line of weakness 73. In the configuration shown in FIG. 6, the opening device 5 is removable from the flexible package 10.

Figure 7:
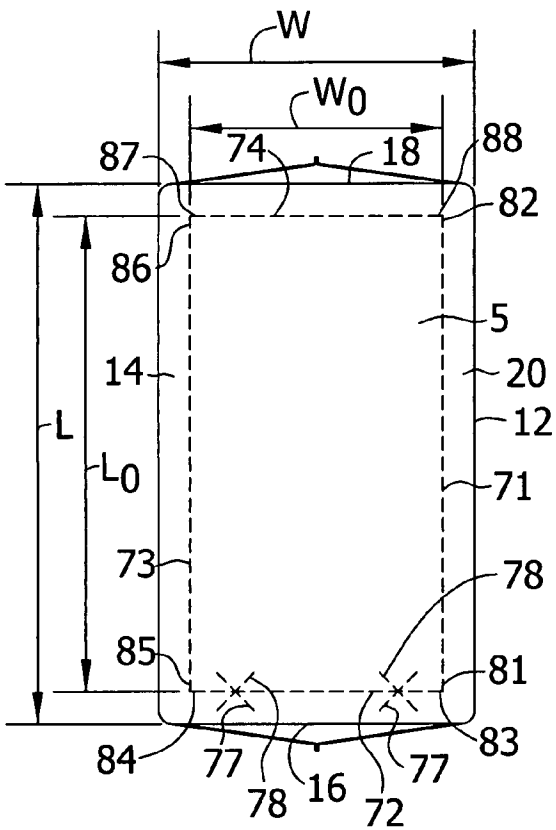
FIG. 7 shows a top view of the flexible package of the present invention with an opening device configuration with an opening aid.

FIG. 7 illustrates an opening device having four lines of weakness, including a first line of weakness 71, a second line of weakness 72, a third line of weakness 73 and a fourth line of weakness 74. The first line of weakness 71 has a first end 81 and a second end 82, the second line of weakness 72, has a first end 83 and a second end 84, the third line of weakness has a first end 85 and a second end 86 and the fourth line of weakness has a first end 87 and a second end 88. The first end 81 of the first line of weakness 71 is adjacent the first end 83 of the second line of weakness 72, the second end 84 of the second line of weakness 72 is adjacent the first end 85 of the third line of weakness 73, the second end 86 of the third line of weakness is adjacent the first end 87 of the fourth line of weakness 74 and the second end 82 of the first line of weakness 71 is adjacent the second end 88 of the fourth line of weakness 74.

In the embodiment of FIG. 7, the first line of weakness 71 is parallel to the third line of weakness 73 and the second line of weakness 72 and fourth line of weakness 74 are perpendicular to both the first and third lines of weakness 71 and 73. As a result, the second line of weakness 72 is parallel to the fourth line of weakness 74.

Figure 5:
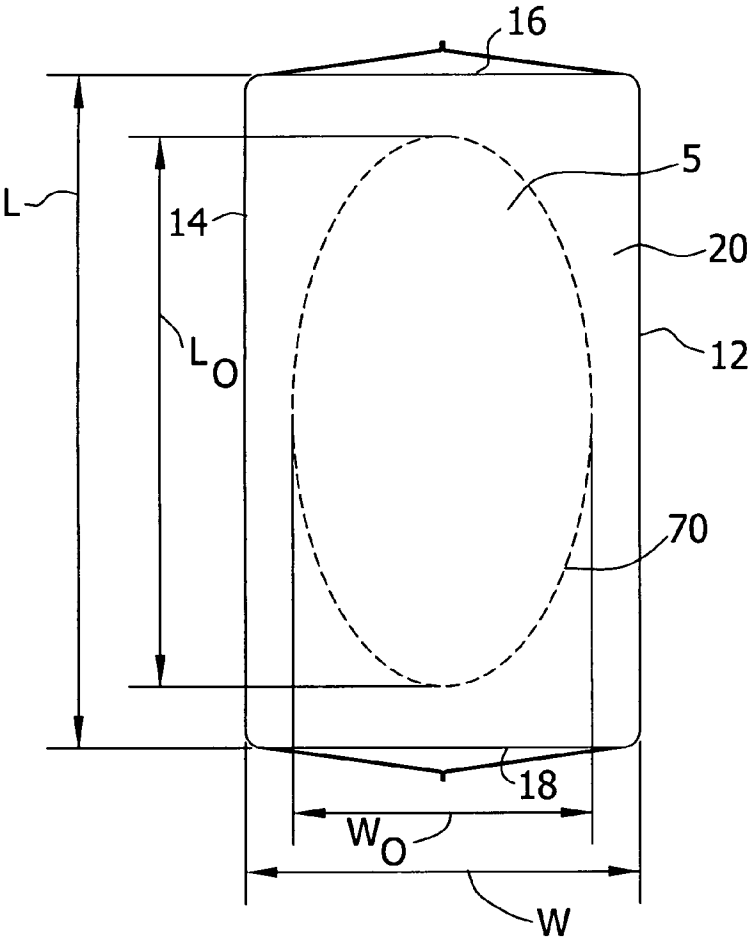
FIG. 5 shows a top view of the flexible package of the present invention with an alternative opening device configuration.
Figure 8:
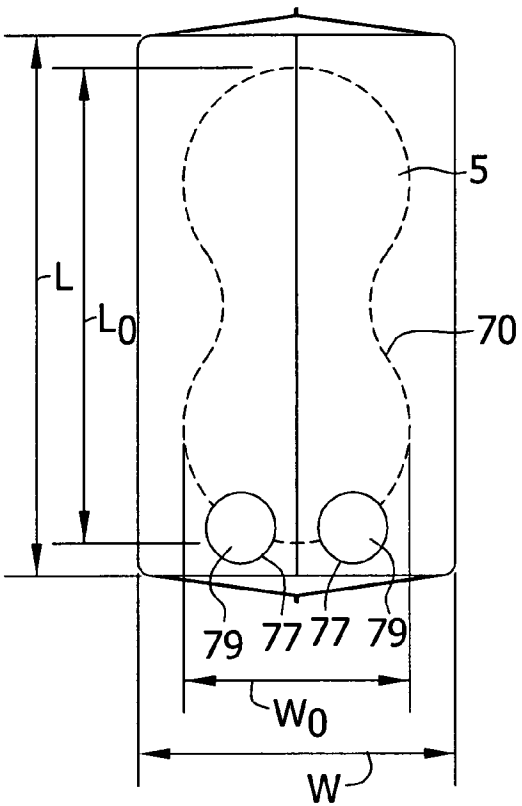
FIG. 8 shows a top view of the flexible package of the present invention with an opening device configuration with an alternative opening aid.

In FIGS. 5 and 8, the opening device is a single continuous line of weakness 70 having an oval shape (FIG. 5) or a bilobal shape (FIG. 8). The shape of the opening device is not critical to the present invention, so long as the width Wo and length Lo conditions mentioned above are met. Shapes and configurations other than those shown in the figures may be used without departing from the scope of the present invention.

In FIGS. 1, and 6-10, the end of one line of weakness is adjacent to the end of another line of weakness, and is shown in these figures to be essentially the same point. However, it is not necessary in the present invention for the end of one line of weakness to be the same point or essentially the same point as the end of another line of weakness. In this case, the end points of the lines of weakness should be sufficiently close together such that the opening device may be opened without requiring much additional force to open the opening device. Optionally, the end of one line of weakness may be joined to the end of another line of weakness by a connecting line. In this regard, attention is directed to FIGS. 1 and 11, which show an opening device having four lines of weakness, including a first line of weakness 71, a second line of weakness 72, a third line of weakness 73 and a fourth line of weakness 74. The first line of weakness 71 has a first end 81 and a second end 82, the second line of weakness 72, has a first end 83 and a second end 84, the third line of weakness has a first end 85 and a second end 86 and the fourth line of weakness has a first end 87 and a second end 88. The first end 81 of the first line of weakness 71 is adjacent the first end 83 of the second line of weakness 72, the second end 84 of the second line of weakness 72 is adjacent the first end 85 of the third line of weakness 73, the second end 86 of the third line of weakness is adjacent the first end 87 of the fourth line of weakness 74 and the second end 82 of the first line of weakness 71 is adjacent the second end 88 of the fourth line of weakness 74.

Figure 11:
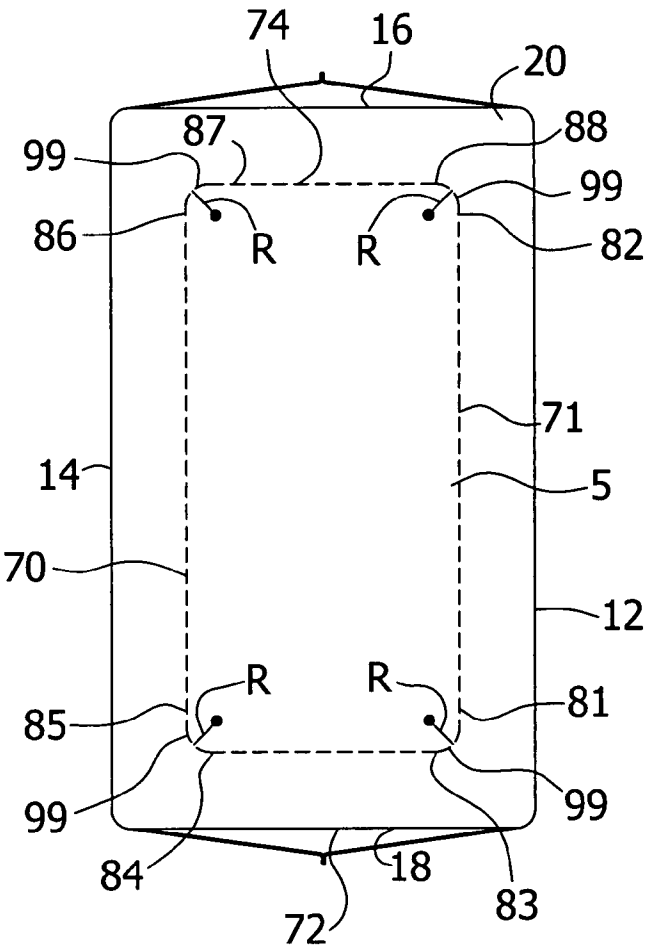
FIG. 11 shows a top view of the flexible package of the present invention with an alternative opening device configuration.

As is also shown in FIG. 11, the end of each line of weakness is joined to the end of another line of weakness using a connecting line 99. The connecting line 99 may be a straight line, an arc, a zig-zag line or the combination of all three types of line. Other connecting lines may be used without departing from the scope of the present invention. If the connecting line 99 is an arc, the arc will have a radius R. The radius of the arc is not important to the present invention, but the radius is generally less than about 5 inches (12.7 cm), but the radius selected may be adjusted, depending on the size of the opening and the size of the flexible package 10.

FIGS. 5, 6, 7, 8 and 11 each show a removable opening device. In contrast, the opening devices shown in FIGS. 1, 9 and 10 are not designed to be removable. In the present invention, by having an opening device which is not removable, the opening device may be used to cover and protect the articles contained within the interior compartment. On the other hand, by having an opening device which is removable, other uses of the opening device may be obtained, which are described in more detail below. If the opening device is not removable, it may contain an additional means for holding the opening device in a closed position after opening and possibly reattaching the opening device to the top surface. Examples of such holding means include, for example, a piece of tape which extends beyond the edge of the opening device, and other such means which will allow for closing of the opening device.

The opening device may also contain an opening aid. An opening aid provides a means for a consumer to grab the opening device 5 and open the opening device 5. The opening aid may be located within the opening devices, externally attached to the opening device or close to the opening device so that a consumer can grab the opening aid and/or the opening device. The opening aid should be adapted or sized to receive at least one human finger so that the consumer may insert their finger and grab the opening aid or opening device. In one configuration of the present invention, the opening aid is located close to or within the opening device. Ideally, the opening aid should be sized and shaped to receive two, three or four fingers of a person's hand so that the person's fingers can be positioned in the opening aid to provide a means for the user to grab and open the opening device. In one aspect of the present invention, the opening aid may be a tab attached to the opening device (not shown in figures).

Attention is directed to FIGS. 7-9 which all show possible configurations for the opening aid 77. In FIGS. 7 and 9, the opening aid 77 includes lines of weakness 78 which are of a size and shape which enable the consumer to insert their fingers into the flexible package 10, so that the opening device 5 can be placed between the consumer's fingers. The lines of weakness 78 are similar to the lines of weakness of the opening device 5. In FIG. 7, the lines of weakness 78 are configured in a crisscross shape. In FIG. 9, the lines of weakness 78 of the opening aid 77 are configured in a circular shape. It is noted that other shapes are within the scope of the present invention and can be used without departing from the present invention. Other possible shapes include, for example, square, rectangular, triangular, a Y-shape, an I-shape, a U-shape, a single line and the like. As a consumer attempts to insert their fingers into the opening aid 77, the lines of weakness 78 are caused to separate, allowing the consumer or user of the articles to easily insert their fingers through opening aid 77.

In another possible configuration shown in FIG. 8, apertures 79 are located in a location on the top surface of the flexible package, within the opening device or closely adjacent the opening device. The apertures function as an opening aid 77 and are of sufficient size to allow a consumer or user of the articles within the flexible package to insert at least one finger into an aperture. It is noted that FIG. 8 shows two apertures; however, it is within the present invention to have a single aperture or more than two apertures. In addition, the apertures may be shapes other than the circular, as shown in FIG. 8. The aperture opening aid may also serve a second purpose, allowing any trapped air to escape the flexible package as the articles are loaded into the flexible package and the flexible package is sealed. Other possible shapes for the aperture may be used including square, rectangular, triangular, a Y-shape, an I-shape, a U-shape, a single line and the like, provided that a user can insert at least one finger into the opening aid.

Figure 13:
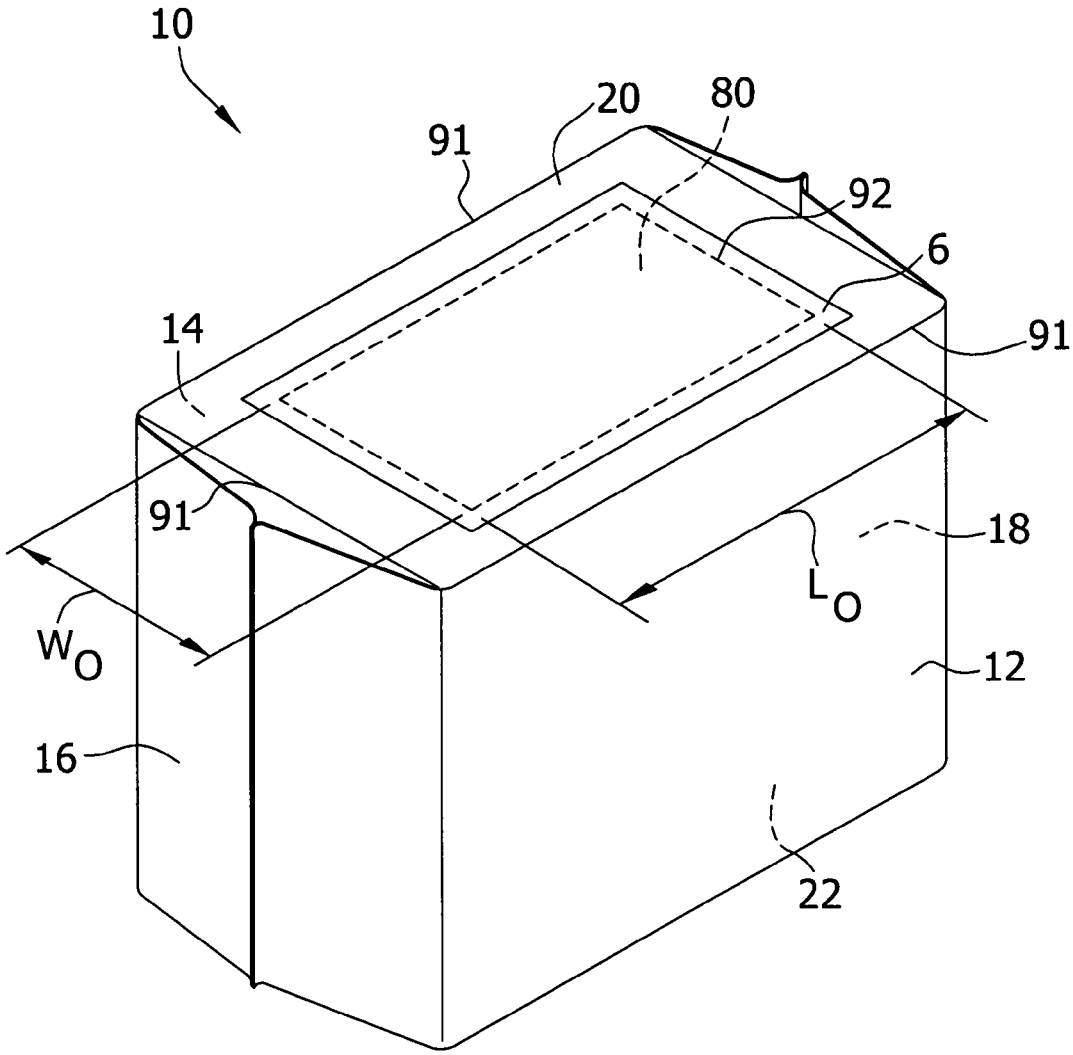
FIG. 13 shows a perspective view of the flexible package of the present invention with a preformed opening and a covering device.

In an alternative configuration, the top surface 20 has an opening preformed therein, similar to the opening 80 shown in FIG. 13. In this configuration, the opening 80 is confined to the top surface such that there is a portion of the top surface located between the opening 80 and an edge 91 created by the direct or indirect connection of the top surface to the at least one side wall. The opening 80 has a parameter edge 92 and has a width Wo at some point along the length L of the opening which is between about 40% and about 99% of the width W of the top surface and a length Lo at some point along the width W of the opening which is between about 40% and about 99% of the length L of the top surface. In one embodiment, the opening 80 has a width Wo at its widest point along the length Lo of the opening 80 between about 50% and about 90% of the width W of the top surface. Desirably, the width Wo at its widest point along the length Lo of the opening device is between about 60% and about 80% of the width W of the top surface. In a similar manner, the opening 80 has a length Lo at its longest point along the width Wo of the opening 80 between about 50% and about 90% of the length L of the top surface. Desirably, the length Lo at its widest point along the width Wo of the opening device is between about 60% and about 80% of the length L of the top surface. The opening 80 allows a consumer to access the articles 26 within the interior compartment 24 of the flexible package. The opening 80 provides for easy access to articles within the interior compartment of the flexible package.

In the case where the flexible package has a preformed opening 80, the opening should be covered by a covering device 6, so that the articles 26 are retained within the interior compartment 24, prior to opening. In one aspect of the present invention, the covering device 6 may also function as an opening device 5 and may also contain opening aids as described above. For example, the covering device may be larger than the opening and may cover up to the entire top surface 20 of the package. Generally, the covering opening device should be slightly larger than the opening 80. The covering device may be secured to the top surface 20 using any means known to those skilled in the art and may be temporary or a permanent securing means. Examples of a securing means include, without limitation, adhesives, thermal bonds, ultrasonic bonds, stitching, spot welds and the like. Of these securing means, adhesives are generally desired, since the adhesive can be selected such that the covering device may be resecured to the top surface, thereby protecting the articles inside the interior compartment.

Figure 14:
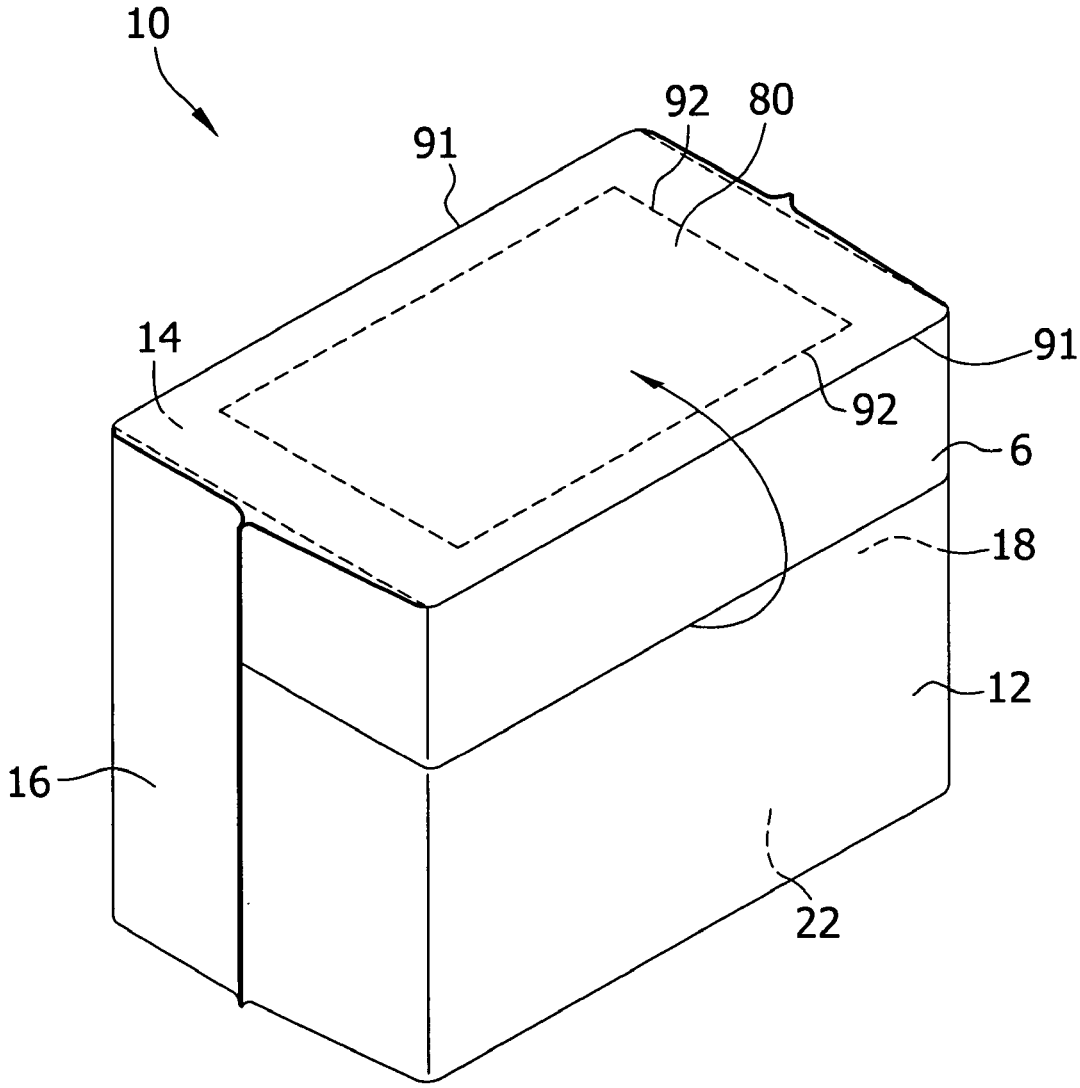
FIG. 14 shows a perspective view of the flexible package of the present invention with a preformed opening and another covering device in a closed position.
Figure 15:
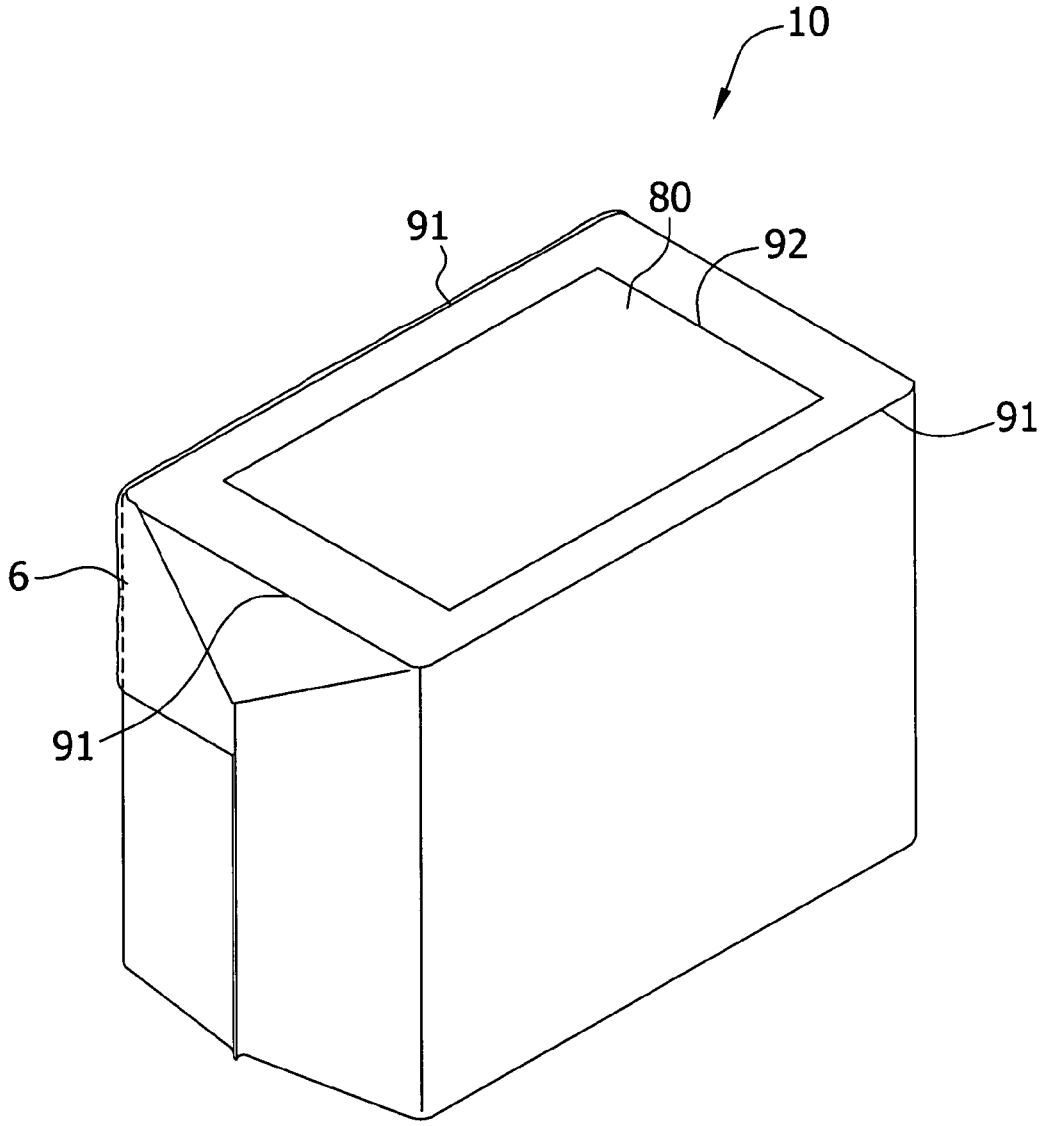
FIG. 15 shows a perspective view of the flexible package of the present invention with a preformed opening or opening device and covering device shown in FIG. 14, with the covering device in an opened position.

Another possible covering device 6 is shown in FIGS. 14 and 15. This covering device may be used whether the package has a preformed opening 80 or an opening device 5 shown in FIGS. 1, 2, and 5-9. The covering device is attached to one of the surfaces, generally the back 14, front 12 or top surface of the package 10 and is of sufficient size to cover the opening 80, the top surface 20 and at least a portion of the sides 16 and 18, the front 12 and the back 14 of the package 10. This covering device may be formed from the same material in which the package is constructed, or may be prepared from a different material.

Referring now to FIGS. 1-3, the flexible package 10 is constructed with at least one gusset 32, and desirably, with a pair of gussets 32 and 34. By a "gusset" it is meant a member, for example a triangular member, capable of strengthening and/or enlarging the flexible package 10. The gusset 32 can be a separate piece of material or can be an extension of or integrally formed from the material from which the flexible package 10 is constructed. The gusset 32 can be viewed as a pocket, receptacle, cavity or opening. The gusset 32, or gussets 32 and 34, are located in the top of the package 10 and are exposed to make them visible to the ultimate consumer. When two gussets 32 and 34 are present, they can be located on the opposite sides of the top wall 20, on opposite sides of the bottom wall 22 or one in the top wall 20 and one in the bottom wall 22 so as to provide a natural location where the consumer can easily grasp the package 10. The first gusset 32 is formed in at least a portion of the side wall 16 and the second gusset 34 is formed in at least a portion of the side wall 18. Each of the gussets 32 and 34 is shown as having a triangular configuration, although variations of the triangular shape can be employed.

The actual configuration of the gussets 32 and 34 can be formed by folding the material from which the package 10 is constructed. Each of the gussets 32 and 34 has a first end 36 that can be aligned with the top wall 20 or can be slightly offset therefrom. Each of the gussets 32 and 34 has a second end 38 which is spaced away from the first end 36 and extends downward toward the bottom wall 22. The first end 36 represents the base of the triangular configuration of each of the gussets 32 and 34 and the second end 38 represents the apex of the triangular configuration. Each of the gussets 32 and 34 has a height $h_1$ that extends at least about 10% of the package height h (see FIG. 3). Desirably, each of the gussets 32 and 34 has a height $h_1$ that extends at least about 30% of said package height h. More desirably, each of the gussets 32 and 34 has a height $h_1$ that extends from between about 20% to about 90% of the package height h. The height $h_1$ of the gusset 32 or 34 can vary depending upon the width of the package 10. For example, as the width of a package 10 increases, the height $h_1$ of the gusset 32 or 34 may generally get bigger.

Each of the gussets 32 and 34 is aligned inward of a portion of one of the pair of opposing side walls 16 and 18 to form a pocket 40. Each pocket 40 has an internal panel (not shown) and an external panel 44. Each pocket 40 is formed by folding the material forming the package 10 such that the internal panel and the external panel 44 are joined together and extend diagonally downward from the opposite upper corners of the package 10 down to the second end 38. In FIG. 3, the front wall 12, the top wall 20 and the side wall 16 form a front upper corner 46 while the back wall 14, the top wall 20 and the side wall 16 form a back upper corner 48 (see FIG. 1). The internal and external panels are each joined at the corners 46 and 48 and have a common line of intersection that diverges diagonally downward and inward toward the second end 38. The function of the gussets 32 and 34 is to strengthen the upper region of the side walls 16 and 18 and to provide an enlarged area whereby the consumer can position one, two or more of his or her fingers so as to easily carry the package 10.

Figure 4:
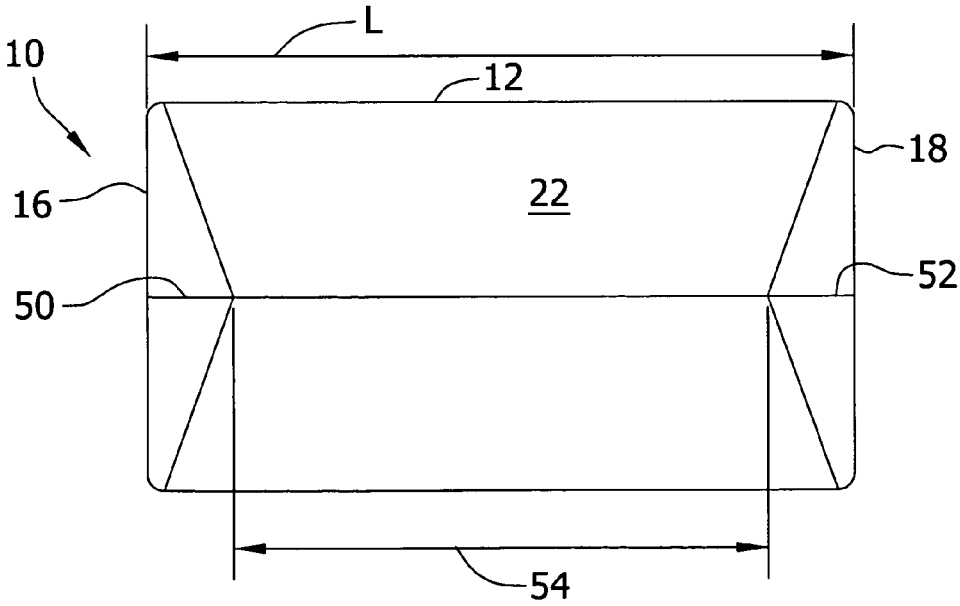
FIG. 4 shows a bottom view of the flexible package of the present invention depicting a bottom seal.

Referring now to FIGS. 1-4, the flexible package 10 also includes a pair of seals 50 and 52, each formed in the opposing side walls 16 and 18. The pair of seals 50 and 52 can be formed by a heat and pressure bond, by a thermal bond, by an ultrasonic bond, by adhesive or by another means known to those skilled in the art. The pair of seals 50 and 52 is present in the external panels 44 of the pockets 40 and each spans the entire height H of the package 10. Each of the pair of seals 50 and 52 extends from the first end 36 of one of the gussets 32 and 34 downward into the bottom wall 22. The pair of seals 50 and 52 can be aligned parallel to the central longitudinal axis of the side wall 16, if desired. In FIG. 4, one can see that the pair of seals 50 and 52 actually extends into and across a portion of the bottom wall 22. The distance that each of the pair of seals 50 and 52 extends across a portion of the bottom wall 22 can vary. Desirably, the pair of seals 50 and 52 will extend across at least about 10% of the length L of the bottom wall 22. The purpose of the pair of seals 50 and 52 is to secure the pair of side walls 16 and 18 together whereby the front wall 12, the back wall 14, the pair of side walls 16 and 18, and the top wall 20 create the internal compartment 24 which is open only at the bottom wall 22. The package 10 is designed to have the multiplicity of articles 26 inserted into it via the open bottom wall 22. After the articles 26 are positioned within the package 10, the bottom wall 22 will then be sealed.

Referring to FIG. 4, a bottom seal 54 may also be present and is formed in the bottom wall 22 after a plurality of articles 26 are placed into the internal compartment 24 of the package 10. Desirably, the articles 26 are compressed before being positioned within the internal compartment 24. Once the articles 26 are positioned with the package 10, the bottom wall 22 is sealed by any of the bonds described above with reference to the pair of seals 50 and 52. A heat and pressure bond works well for a polymeric film material. The bottom seal 54 cooperates with said pair of seals 50 and 52 to completely enclose the articles 26 within the package 10. By "completely enclose" it is meant that the plurality of articles 26 are surrounded on all sides by the material forming the package 10. The bottom seal 54 can be aligned parallel to the central transverse axis of the package 10, if desired.

The package 10 can be prepared from a single piece of material or can be prepared from multiple pieces of material. If multiple pieces of material are used, the individual pieces must be joined together using a suitable means. For example, the individual pieces may be joined by various conventional techniques, such as adhesive bonding, thermal bonding, ultrasonic bonding, welding, and so forth. In another embodiment, the panels are connected with mechanical fastening systems, such as sewing, stapling, riveting, and so forth. In one embodiment, the package 10 is formed from a continuous roll of material having a pre-formed gusset and perforations.

Sealing of the two panels at the side seam, such as with heat and compression, which also causes the individual bags to separate during production.

In all instances, it is important that adequate welds or seals are produced at all locations. A combination of time, temperature, pressure, seal area and/or bag film materials may be used to accomplish an adequate seal as is known in the art. Seals are tested using standard industry methods, although seal strength requirements vary by individual specifications, depending on consumer, product and equipment needs. Strength tests are performed not only on the bag, but also on both side seams (including gusset area seals), as well as the perforations by methods known in the art. In some instances, an AMTS Sintech 1" made by MTS Systems Corporation in Minneapolis, Minn. is used to test seal and perforation strength.

The package 10 may be made from any one of a wide variety of materials that are known in the art to be sufficiently flexible to accommodate the desired number of articles 26 and have sufficient strength to hold and contain the articles 26 without breaking and without excessive bulging or stretching of the material. Materials include, but are not limited to, polymeric plastic films, foils, paper, paper composites, knitted or woven fabrics, nonwoven fabrics and the like, or a combination thereof. Suitable materials can be made from polymeric materials such as polyethylene, polypropylene, polyester, nylon, and the like, as well as any combination thereof. In one embodiment, the material is a low density polyethylene (LDPE) film. In another embodiment, the material is a LDPE/LLDPE (linear low density polyethylene) film laminate. In yet another embodiment, the material is a LDPE/MDPE (medium density polyethylene) film laminate, a LDPE/HDPE (high density polyethylene) film laminate or the like. In another embodiment a polyethylene/polypropylene combination is used. In a specific embodiment, the material is a polyethylene film or film laminate having a thickness of between about 1 and about 5 mils (about 0.025 to 0.125 mm).

Referring to FIG. 3, the flexible package 10 may be filled with a plurality of articles 26. The articles 26 can be randomly or uniformly arranged within the package 10. Desirably, the articles 26 are placed within the interior compartment 24 of the package 10 in a uniform arrangement, in particular, arranged within the interior compartment 24 in one or more rows. In one configuration, as shown in FIG. 3, the articles 26 are arranged in at least one row 28 which extends from one side wall 16 to the other side wall 18. Other possible configurations include arranging the articles 26 in at least one row which extends from top surface 20 to the bottom surface 22 (not shown) or in at least one row which extends from the front wall 12 to the back wall 14 (also not shown). The number of rows of articles 26 contained within the interior compartment 24 is not critical to the present invention and is generally dependant on the size of the articles in relation to the size of the package 10. As is shown in FIG. 3, two rows of articles 28 and 30 are depicted with an upper row 28 being located above a lower row 30 within the interior compartment 24 of the package 10. Other arrangements of the articles could be used. For example, two rows could be arranged side-by-side, or more than two rows of articles could be present in the interior compartment 24. Likewise, the package 10 can contain within the interior compartment 24 two or more rows arranged along the lower portion of the package 10 and two or more rows located above the lower rows. For example, a package can contain two bottom rows and two vertical rows thereby forming an aggregate of four rows within the package. Another example would be a package containing two bottom rows and three vertical rows thereby forming an aggregate of six rows within the package. Any other conceivable arrangement may be used for the articles 26 contained within the package 10 without departing from the present invention.

Each row 28 and 30 can consist of a plurality of articles 26. As shown in FIG. 3, each of the rows 28 and 30 contains 16 articles. However, it should be readily apparent that the number of articles 26 contained within a given row may vary. For disposable absorbent articles, either wrapped with a wrapper material or unwrapped, the number of articles 26 enclosed within a single package 10 usually ranges from between about 3 to about 200. Generally, there are from about 5 to about 100 disposable absorbent articles in a given row. Particularly, there are from about 8 to about 50 disposable absorbent articles in a given row. The number of articles 26 in each row 28 and 30 can be the same or can differ. The articles 26 may be capable of being compressed. Desirably, each article 26 can be compressed by at least 10%, and desirably, by at least 20%. By compressing the articles which are capable of being compressed, the overall size of the package can be reduced, thereby providing a savings of package material and storage space. The articles 26 may be almost any type of article. One particular use of the flexible package of the present invention is to hold and dispense disposable absorbent personal care articles 26. A disposable absorbent personal care article is a product that is primarily designed and constructed to absorb human discharge, such as urine, menses and/or fecal matter. The disposable absorbent article is a product that is designed for a single use before it is discarded and is not intended to be laundered and reused. Examples of disposable absorbent articles 26 include infant diapers, training pants, sanitary napkins, feminine pantiliners and pads, tampons, adult incontinence garments, such as pads, briefs and undergarments, as well as other disposable absorbent products.

Figure 12:
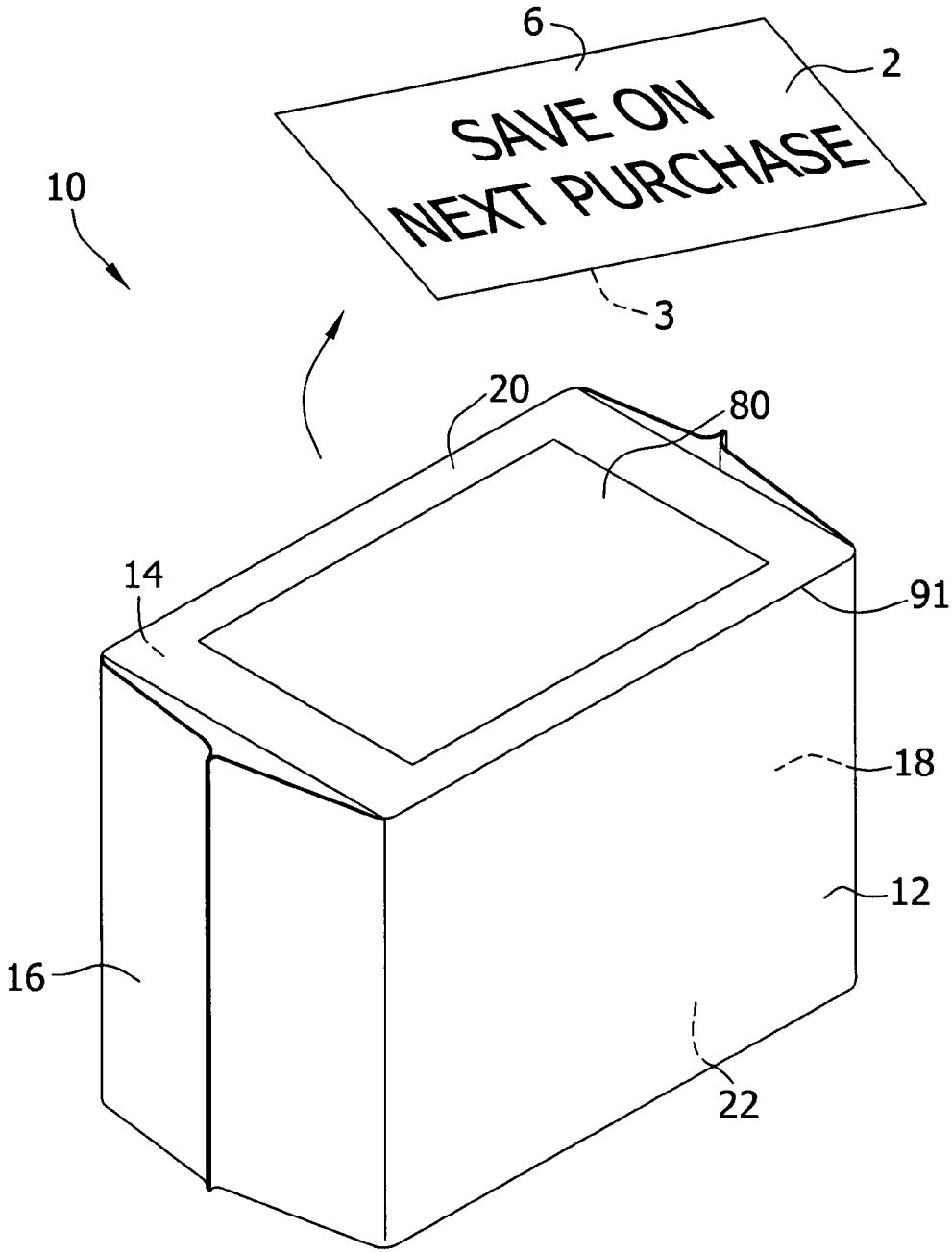
FIG. 12 shows a perspective view of the flexible package of the present invention with the opening device removed and a message on the reverse side of the opening device.

The opening device 5 of the embodiments of FIGS. 1-11 and the covering device 6 of the embodiments of FIGS. 12-15 may also be printed with information which may be conveyed to the consumer. For example, as illustrated in FIG. 12, the covering device 6 has a front side 3 and a back side 2. The front side 3 is the side of the covering device 6 that the consumer or user sees when the package 10 is closed and the back side 2 of the covering device 6 is viewable when the covering device is removed. Information which may be provided on the back side 2 of the covering device 6 includes, without limitation, an inspirational message, a promotional offer such as coupons for future purchase of a similar or different product and points towards an offer such as free products, a proof of purchase, information regarding the absorbency and size of the product contained within the interior compartment 24, a guide to other similar products within a given product line, a thank you message and the like.

In addition, the package 10 may be provided with other features, including windows or clear panels to view the articles 26 inside the interior compartment 24.

The dimensions of the package 10 may vary, depending on the type and number of articles 26 being packaged. Generally, the package 10 has a rectangular structure, although the invention is not so limited. In one embodiment, the package is about 16 cm in height, about 22 cm in length, and about 10 cm in width (depth). Of course these dimensions can be varied, depending on the type, amount and size of the articles 26 which are placed in the package 10, without departing from the scope of the present invention. The base or bottom surface of the package should be of a sufficient width and length so that the base or bottom surface will support the height of the package, although this is not required of the present invention. Although not shown in the figures herein, the corners of the packages, such as the corner defining the transition from the top section 20 to the front or back surface 12 or 14, are slightly curved. Other conventional construction features of the bag 10 should be understood by those skilled in the art and will not be discussed in detail herein. Essentially, any type of flexible bag known in the art can be used, and further information on material choices is given below.

If the package of the present invention is filled with absorbent personal care articles, generally the height of the flexible package should be at least about ¼ of the width W. Usually, the height of the package is at least about ¾ of the width and often greater than or equal to the width. Of course, the size and ratio of the height to width of the package may be adjusted according to the types of articles stored and dispensed from the package.

In the present invention, the opening devices 5 in any of the embodiments set forth herein may be highlighted to direct a user's attention to the location where the flexible package may be opened. Highlighting may be accomplished by various means, including, for example, coloring the opening device a color which does not appear on the remainder of the package, outlining the opening device with color which attracts attention, e.g. orange or fluorescent type colors, highlighting the lines of weakness or providing other indicia to clearly indicate the location of the opening device. In addition, instructions to the user as to how to open the flexible package may be located on the opening device.

Finally, the opening device and/or opening may be formed on the package in a variety of ways. It may be formed prior to the formation of the flexible package or after the flexible package is formed. Both the opening device and/or opening may be formed by die-cutting the line of weakness or opening into the packaging material while the material is in a flat configuration. Other methods include folding the packaging material in half prior to forming and cutting or perforating the material from the edge where the packaging material is connected and through both of the layers of the folded material. The latter method helps ensure that the opening is symmetrical.

The flexible package of the present invention may optionally be printed or otherwise provided with graphics to convey to the consumer the contents of the flexible package. The graphics on the package, if present, may optionally be coordinated with the contents of the package.

Figure 16:
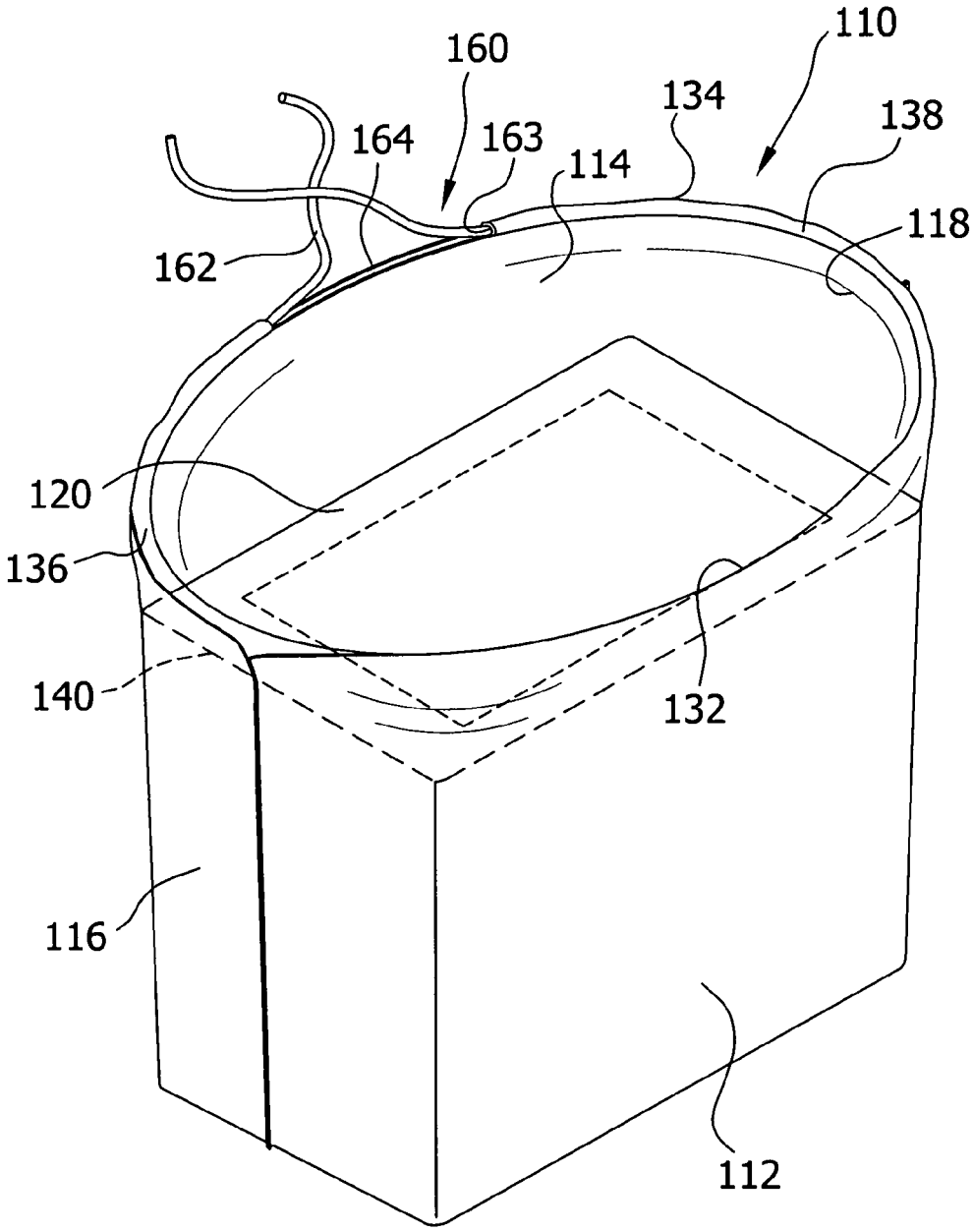
FIG. 16 shows a perspective view of flexible package according to another embodiment and having a closure system for repeated opening and closing of the package.
Figure 17:
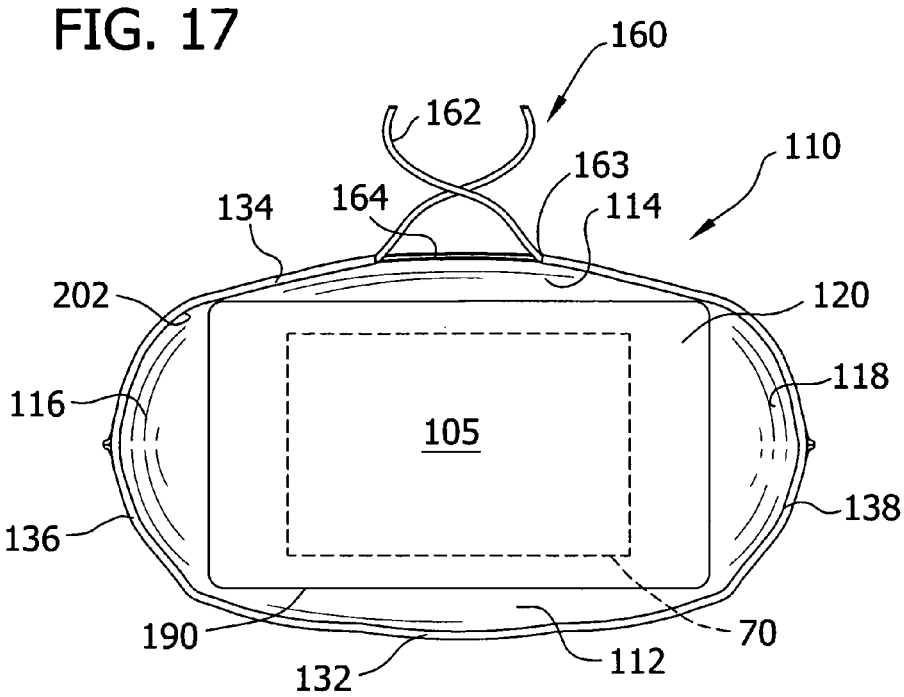
FIG. 17 shows a top plan view of the flexible package of FIG. 16.

With reference now to FIGS. 16 and 17, in another embodiment a flexible package, generally indicated at 110, has a top surface 120, a bottom surface (not shown but substantially similar to the bottom surface 22 of the embodiment of FIGS. 1-4), a front side wall 112, a back side wall 114, a first side wall 116, a second side wall 118, interior compartment 124 (FIGS. 19A, 19B, 19C and 20) defining an interior volume of the package and an opening device 105 as in any of the prior illustrated and described embodiments. As noted previously, the flexible package 110 may alternatively comprise a single continuous side wall, two side walls, three side walls or more than four sidewalls (with side walls of multiple side wall configurations being connected together) without departing from the scope of this invention.

In this particular embodiment, a portion of at least one side wall of the package 110, and more suitably a portion of each of the front side wall 112, back side wall 114, first side wall 116 and second side wall 118 extends outward beyond the location at which the top surface 120 connects to the side walls (e.g., at the peripheral edge 190 of the top surface). For example, in the illustrated embodiment the top surface 120 connects to each of the front side wall 112, back side wall 114, first side wall 116 and second side wall 118 to define the peripheral edge 190 of the top surface. The portions of the side walls 112, 114, 116 and 118 that extend outward beyond the top surface 120 each have a respective free edge 132, 134, 136, 138.

Figure 19A:
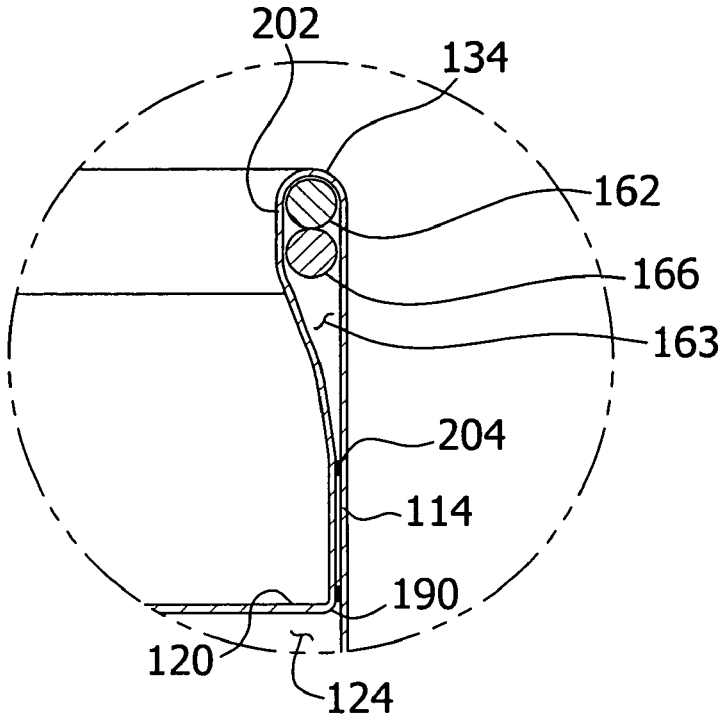
FIG. 19A shows an enlarged portion of the cross-section taken in the plane of line 19-19 of FIG. 18.

In one particularly suitable embodiment, the side walls 112, 114, 116, 118 and top surface 120 are formed integrally with each other as partially illustrated in FIG. 19A, with the top surface secured such as by suitable bonding, welding, adhesive or other suitable securement technique to each of the side walls along a seal line that defines the peripheral edge 190 of the top surface substantially inward of the free edges 132, 134, 136, 138 of the side walls. In this manner, the extended portion of each side wall 112, 114, 116, 118 comprises overlapping layers of the material from which the package 110 is constructed. It is understood, however, that the top surface 120 of the package 110 may be constructed separate from the side walls 112, 114, 116, 118 and subsequently connected thereto by a suitably securement technique to define the peripheral edge 190 of the top surface whereby the side walls are of a single layer construction. Other package 110 constructions in which a portion of one or more of the side walls 112, 114, 116, 118 extends outward of the peripheral edge 190 of the top surface 120 are also contemplated to be within the scope of this invention.

Figure 20:
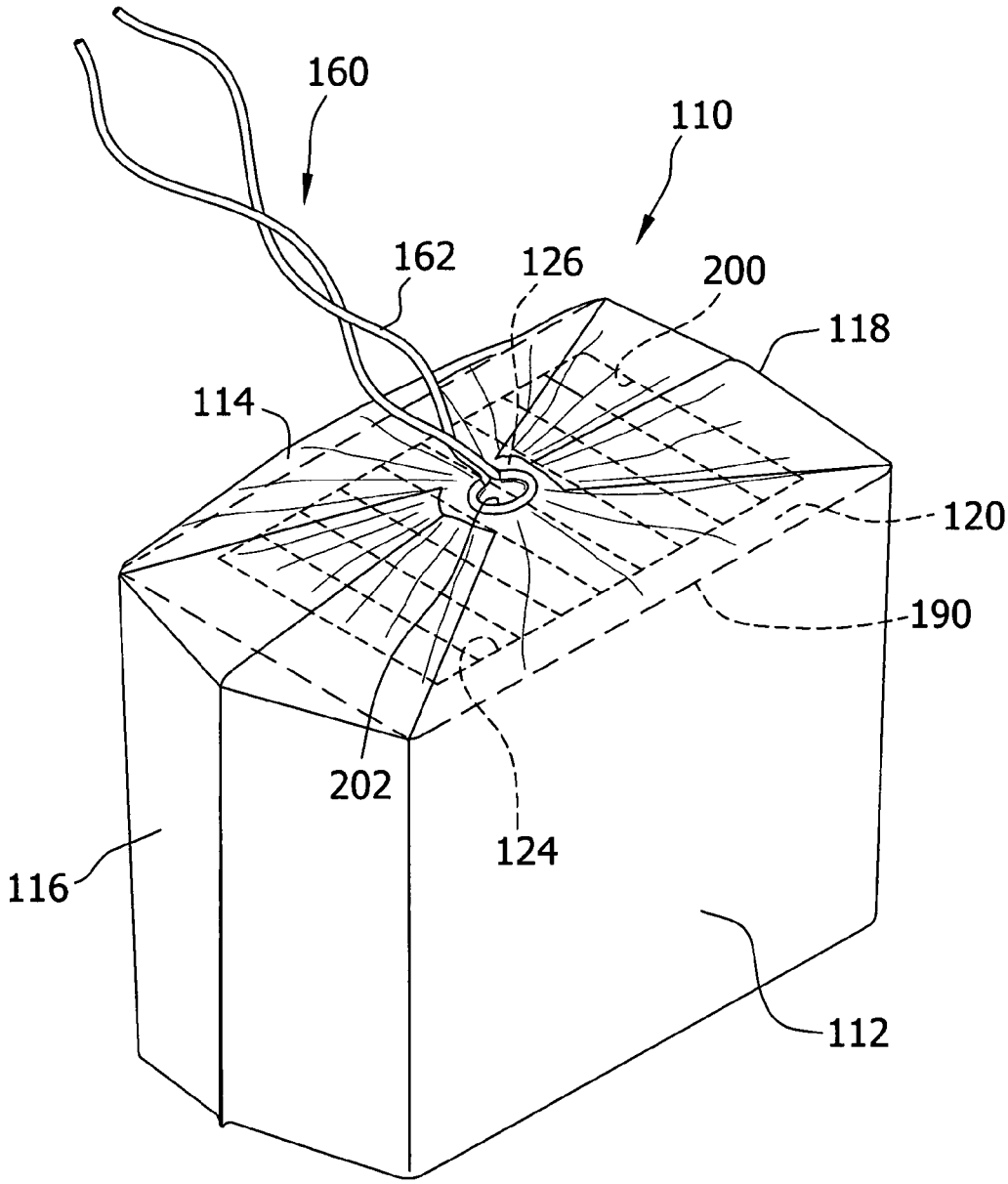
FIG. 20 shows a perspective view of the flexible package of FIG. 16 in a closed configuration of the package.

A closure system, generally indicated at 160, is suitably operable on the package 110, and more suitably on the extended portions of the side walls 112, 114, 116, 118, and even more suitably on the free edges 132, 134, 136, 138 of the side walls to close the package once the opening device 105 is partially or fully detached from the top surface 120 of the package to expose the contents (e.g., articles 126 as illustrated in FIG. 20) of the package. As an example, in the embodiment illustrated in FIGS. 16 and 17 the closure system 160 comprises a drawstring 162 connected to the extended portions of the side walls 112, 114, 116, 118 and circumscribing the package 110.

The drawstring 162 is operable (in the illustrated embodiment, slidable) relative to the package 110 to configure the package, (e.g., the extended portions of the side walls 112, 114, 116, 118 in the illustrated embodiment) between an open configuration as illustrated in FIG. 17 in which the articles 126 within the compartment 124 of the package are accessible for removal from the package upon partial or full detachment of the opening device 105 and a closed configuration (FIG. 20) in which the articles within the interior compartment are inhibited against removal (e.g., intended or unintended) from the package. For example, in the illustrated embodiment the free edges 132, 134, 136, 138 of the extended portions of the side walls 112, 114, 116, 118 together define a second or secondary opening 202 of the package 110 (a first or primary opening being defined by the opening 200 formed in the top surface 105 of the package upon partial or full detachment of the opening device 105 from the top surface as illustrated in FIG. 20). In the open configuration of the package 110 the second opening 202 is at least as large as, and is more suitably larger than, the first opening 200 in the top surface 120 so that the contents are accessible through the opening in the top surface. In the closed configuration, the second opening 202 is substantially narrowed, such as to a size substantially smaller than the first opening 200 formed in the top surface 120 so that the articles 126 within the interior compartment 124 are relatively inaccessible and cannot be manually removed or otherwise fall out of the package 110.

The drawstring 162 may be suitably connected to the package by forming a channel 163 on the package 110, such as adjacent the free edges 132, 134, 136, 138 of the side walls 112, 114, 116, 118, through which the drawstring extends as illustrated in FIGS. 16 and 17. As best illustrated in FIGS. 16 and 17, a segment 164 of one of the extended portions of the side walls 112, 114, 116, 118 (e.g., the back side wall in FIG. 16) is suitably notched or cut to remove the channel 163 formed in the side wall along that segment for accessing the ends of the drawstring 162. The ends of the drawstring 162 are tied together to inhibit the drawstring from being removed from package 110. Alternatively, a clip (not shown) or other suitable coupling device (not shown) may be used to couple the ends of the drawstring 162 together. Pulling on the coupled ends of the drawstring 162 draws the extended portions of the side walls 112, 114, 116, 118 together to substantially narrow the second opening 202 defined by the free edges 132, 134, 136, 138 of the extended portions of the side walls. To open the package 110 the user simply applies an outward directed force to the extended portions of the side walls 112, 114, 116, 118 to thereby expand the second opening 202.

While in the illustrated embodiment the drawstring 162 is connected to the extended portions of the side walls 112, 114, 116, 118 generally at the free edges 132, 134, 136, 138 thereof, it is understood that the drawstring may be connected to the extended portions of the side walls at a location intermediate the free edges and the location at which the top surface 120 connects to the side walls (e.g., the peripheral edge 190 of the top surface). It is also understood that the extended portions of the side walls 112, 114, 116, 118 may be omitted, so that the package 110 is generally similar to the package 10 of FIGS. 1-4, with the drawstring 162 connected to the side walls generally adjacent the location at which the top surface 120 connects to the side walls without departing from the scope of this invention.

Figure 18:
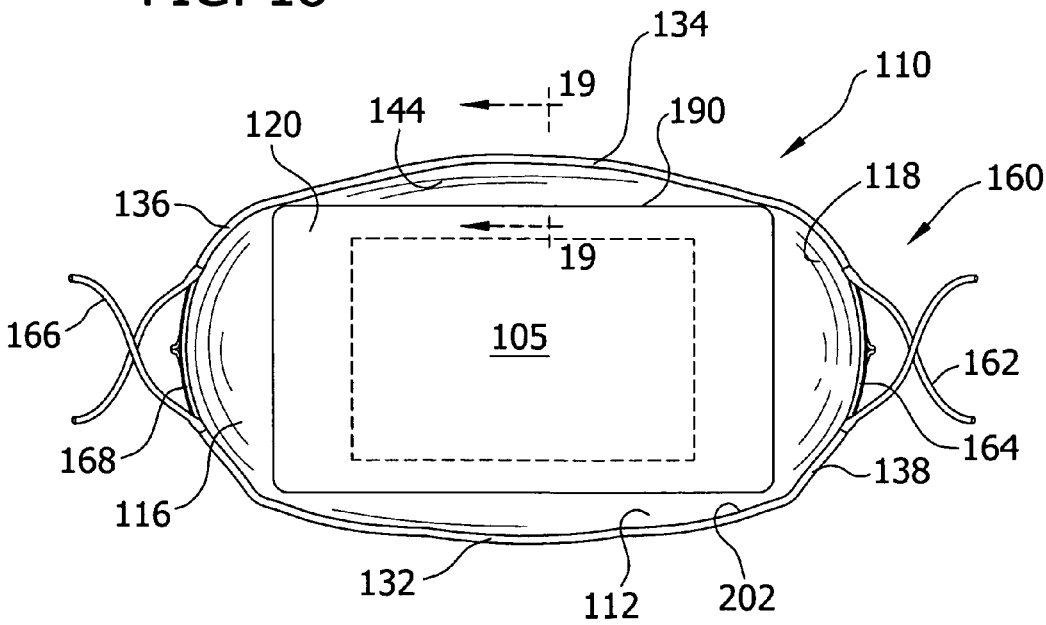
FIG. 18 shows a top plan view of a flexible package similar to the flexible package of FIG. 16 but with a second embodiment of a closure system for the package.

In the alternative embodiment of FIG. 18, the flexible package 110 includes a closure system 160 comprised of a pair of drawstrings 162, 166 connected to the package. In this embodiment, open segments 164, 168 are formed in opposed side walls, e.g., the first and second side walls 116, 118 as illustrated in FIG. 18, or the front and back side walls 112, 114, through which the ends of the respective drawstrings 162, 166 extend outward from the package 110 for accessibility in closing the package. As best illustrated in FIG. 19A, the drawstrings 162, 166 may suitably extend within the same channel 163 formed on the package. The common channel 163 may be formed on the side walls 112, 114, 116, 118 of the package 110 by sealing together the two layers of material of each extended portion of the side walls 112, 114, 116, 118 along a seal line 204 adjacent the free edges 132, 134, 136, 138 in spaced relationship with the seal line that defines the peripheral edge 190 of the top surface 120 of the package.

Figure 19B:
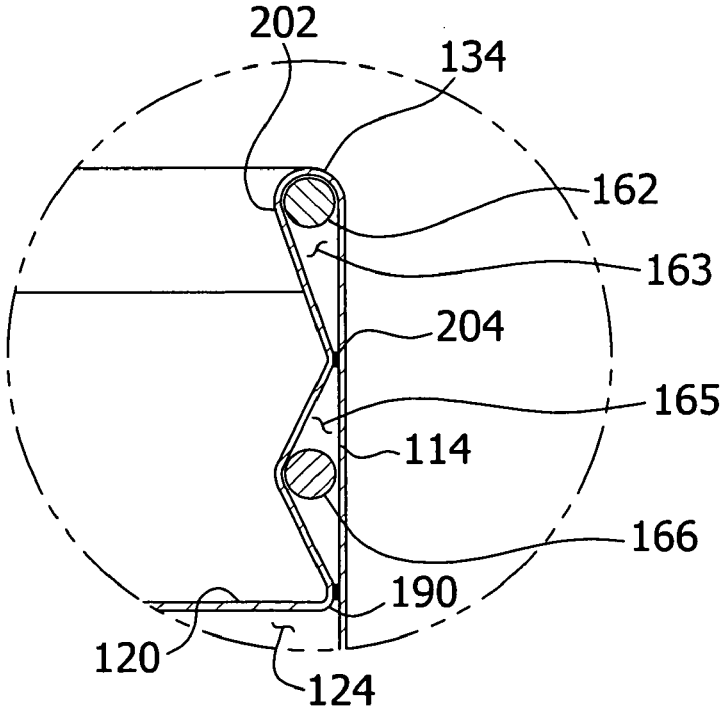
FIG. 19B shows an enlarged portion of a cross-section similar to that of FIG. 19*a* but with an alternative configuration of the closure system.
Figure 19C:
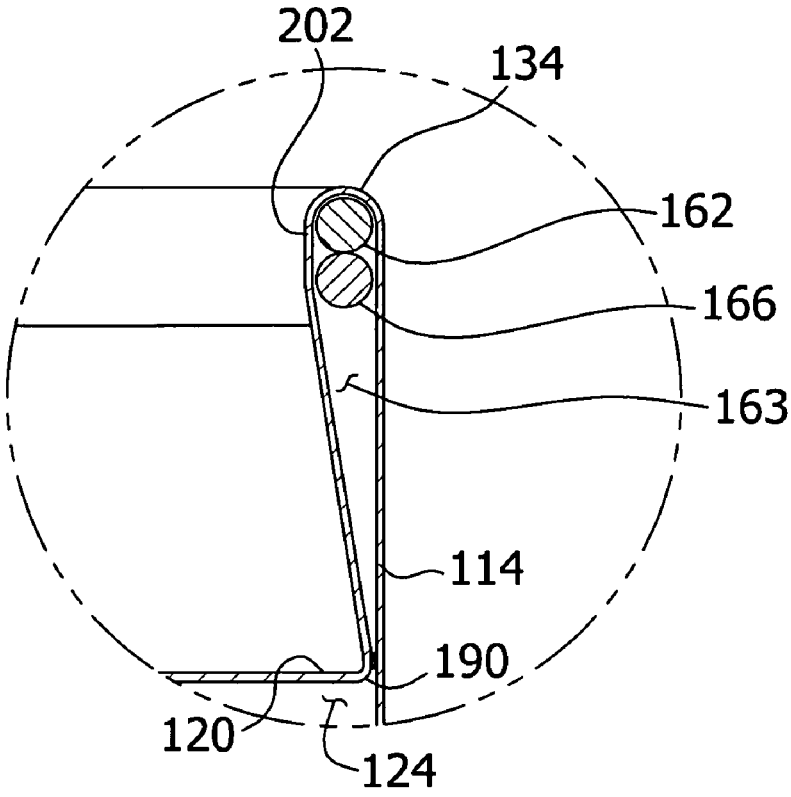
FIG. 19C shows an enlarged portion of a cross-section similar to that of FIG. 19*a* but with yet another alternative configuration of the closure system.

In another embodiment, illustrated in FIG. 19B, one drawstring 162 is disposed in the channel 163 formed adjacent the free edges 132, 134, 136, 138 of the side walls 112, 114, 116, 118 by the seal line 204 and the other drawstring 166 is disposed within the channel 165 formed between the sealing line 204 and the seal line that defines the peripheral edge 190 of the top surface 120. Alternatively, the seal line 204 adjacent the free edges 132, 134, 136, 138 of the side walls 112, 114, 116, 118 may be omitted such that both drawstrings are disposed loosely within a common channel 163 formed between the free edges of the side walls and the peripheral edge 190 of the top surface 120. In such an embodiment, upon pulling the ends of the drawstrings 162, 166 to close the package the drawstrings tend to move within the channel 163 generally to the free edges 132, 134, 136, 138 of the side walls 112, 114, 116, 118 as illustrated in FIG. 19C.

It is understood that the channel, e.g., channel 163 in FIG. 19A, through which the drawstrings 162, 166 extend need not be formed continuously about the side walls 112, 114, 116, 118 to sufficiently connect the drawstrings to the package 110. For example, discrete segments of the side walls 112, 114, 116, 118 may be bonded together to form discrete channels or even small loop features (e.g., in the manner of belt loops) through which the drawstrings 162, 166 extend and are retained on the package. It is also understood that the channel 163 may be formed by a separate strip of material (not shown) secured to the inner surface or the outer surface of the side walls 112, 114, 116, 118 with the drawstring 162, or drawstrings 162, 166, disposed in the channel formed between the side walls and the separate strip of material. Alternatively, discrete loops or other retention members may be secured to the side walls 112, 114, 116, 118 to connect the drawstrings 162, 166 to the package 110 without departing from the scope of this invention.

The drawstrings 162, 166 may be constructed of any material sufficient to withstand the pulling forces required to repeatedly close the package 110. Examples of suitable drawstring 162, 166 materials include, without limitation, nylon, rayon, cotton, other suitable yarn or string materials, polymeric materials, leather or other suitable materials. The drawstrings 162, 166 may also be constructed of an elastic material and remain within the scope of this invention.

While the closure system 160 illustrated in each of the embodiments of FIGS. 16-20 comprises one or more drawstrings 162, 166, it is understood that other suitable closure systems that allow the side walls 112, 114, 116, 118 to be brought together outward of the top surface 120 of package 110 (e.g., over the opening 200 formed in the top surface of the package upon partial or full detachment of the opening device 105) and held in this closed configuration are contemplated to be within the scope of this invention. As an example, other suitable closure systems include, without limitation, a strap (e.g., having refastenable hooks and loops on its surface) or other suitable tie in which the user manually brings the side walls 112, 114, 116, 118 (e.g., at the extended portions thereof in the illustrated embodiments) together and then uses the strap or other suitable tie to hold the side walls together; a fastening system (e.g., hook and loop) in which the side walls are brought together, folded over and releasably fastened in this folded configuration to close the package.

It is understood that flexible packages 20 such as those illustrated in FIGS. 12-15 as having an opening 80 and corresponding covering device 6 may be constructed to have extended portions similar to the extended portions of the side walls 112, 114, 116, 118 of FIGS. 16-20 and a corresponding closure system similar to the closure system 160 of the embodiments of FIGS. 16-20 without departing from the scope of this invention.

Figure 21:
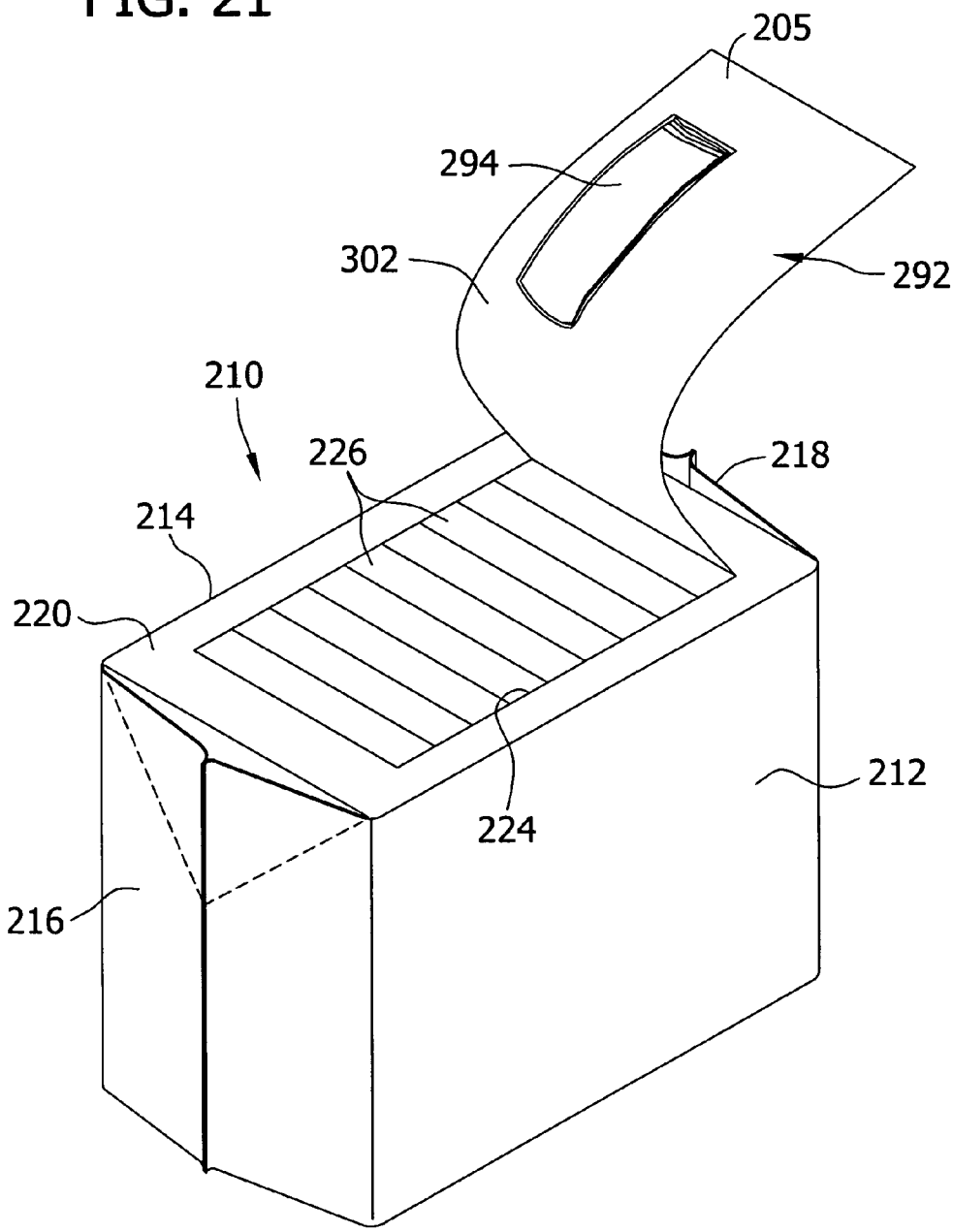
FIG. 21 shows a perspective view of a flexible package according to another alternative embodiment, with an opening device of the package partially detached therefrom and an article secured to the inner surface of the opening device.

With reference now to FIG. 21, in another embodiment a flexible package, generally indicated at 210, has a top surface 220, a bottom surface 222 (FIG. 21A), a front side wall 212, a back side wall 214, a first side wall 216, a second side wall 218, interior compartment 224 defining an interior volume of the package and an opening device 205 as in any of the prior illustrated and described embodiments. As noted previously, the flexible package 205 may alternatively have a single continuous side wall, two side walls, three side walls or more than four sidewalls (with side walls of multiple side wall configurations being connected together) without departing from the scope of this invention.

Figure 21A:
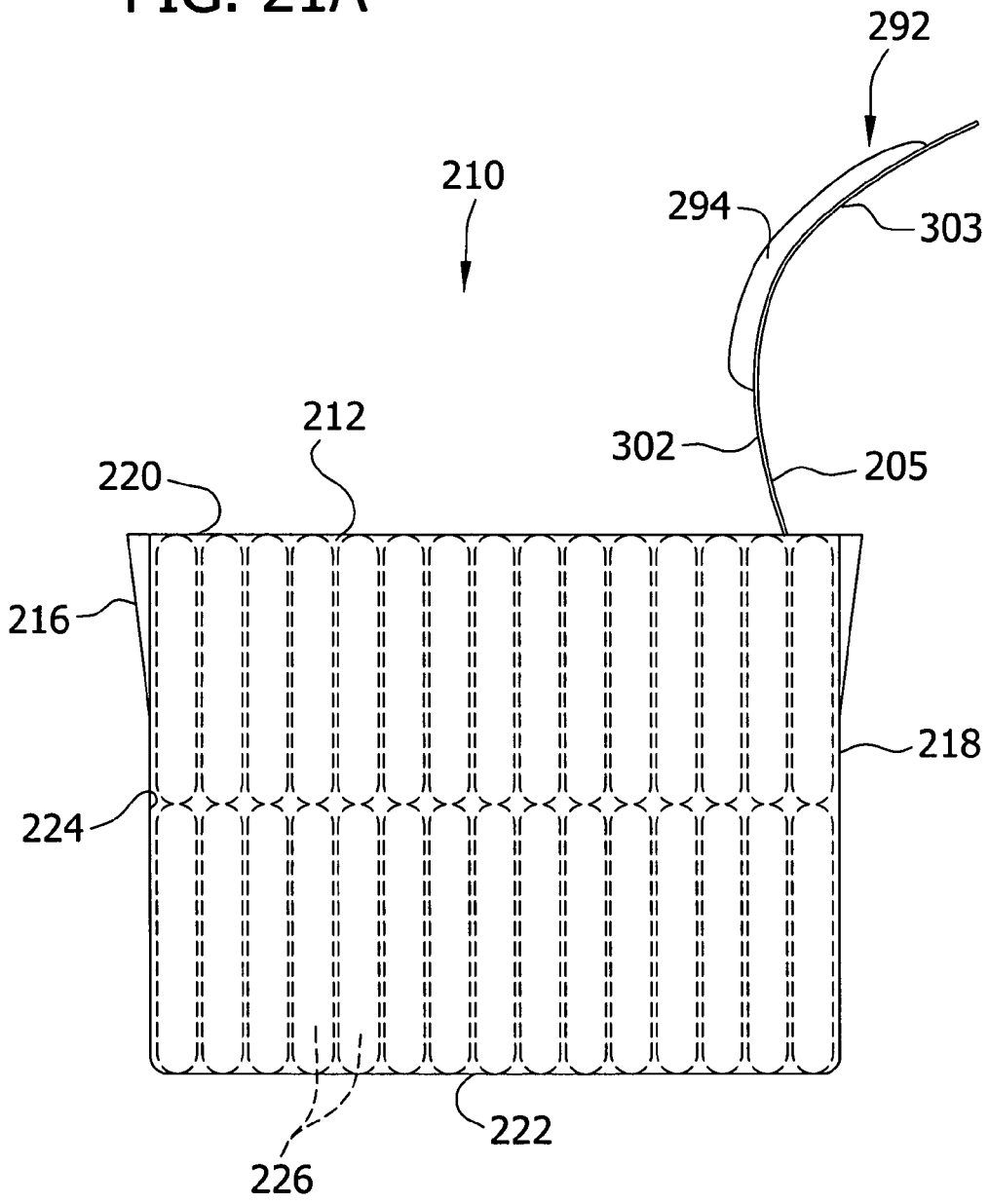
FIG. 21A shows a side elevation of the flexible package of FIG. 21.

In the illustrated embodiment of FIGS. 21 and 21A, an article, generally indicated at 292, is secured to the opening device 205, and more suitably to the back side or inner surface 302 of the opening device, for conjoint movement with the opening device upon partial or full detachment of the opening device from the top surface 220 of the package 210. The article 292 may suitably be different from the one or more articles 226 contained within the interior compartment 224 of the package 210 (which are unsecured to the opening device 205) in at least one characteristic of construction, article type, intended use or other characteristic. It is understood, however, that the article 292 secured to the opening device 205 may be identical to the one or more articles 226 disposed within the interior compartment 224 of the package 210 without departing from the scope of this invention.

As an example, in one embodiment the articles 126 within the package 210 may comprise one or more absorbent articles (broadly, one or more first articles) as that term is defined herein, and the article 292 secured to the opening device 205 (broadly, the second article) may comprise one or more disposable bags in which the absorbent article may be placed and disposed of after use. In particular, the article 292 secured to the opening device 205 may comprise a pocket or pouch 294 as illustrated in FIG. 21 containing a plurality of disposable bags (not shown) for disposing of used absorbent articles.

It is understood, however, that the article 292 (broadly, the second article) secured to the opening device 205 may comprise substantially any article capable of being secured to the opening device and remain within the scope of this invention. The article 292 is suitably sufficiently thin to fit within the interior compartment 224 of the package 210 along with and without damaging the articles 226 within the package. In another embodiment the article 292 is sufficiently pliable (e.g., flexible and/or compressible) to reduce the amount of space required within the compartment 224 to accommodate the article secured to the opening device 205.

As another example, in other embodiments the article 292 secured to the opening device 205 may comprise a pocket or pouch (not shown) of tissues or wet wipes. In still other suitable embodiments the article 292 secured to the opening device 205 may comprise a skin treatment composition (such as a lotion, ointment, powder, and the like) contained in a suitable packaging (e.g., such as a tear open packet) (not shown). The article 292 may alternatively comprise a pharmaceutical, such as in the form of a pill or a liquid, contained in a suitable packaging (not shown).

Figure 22:
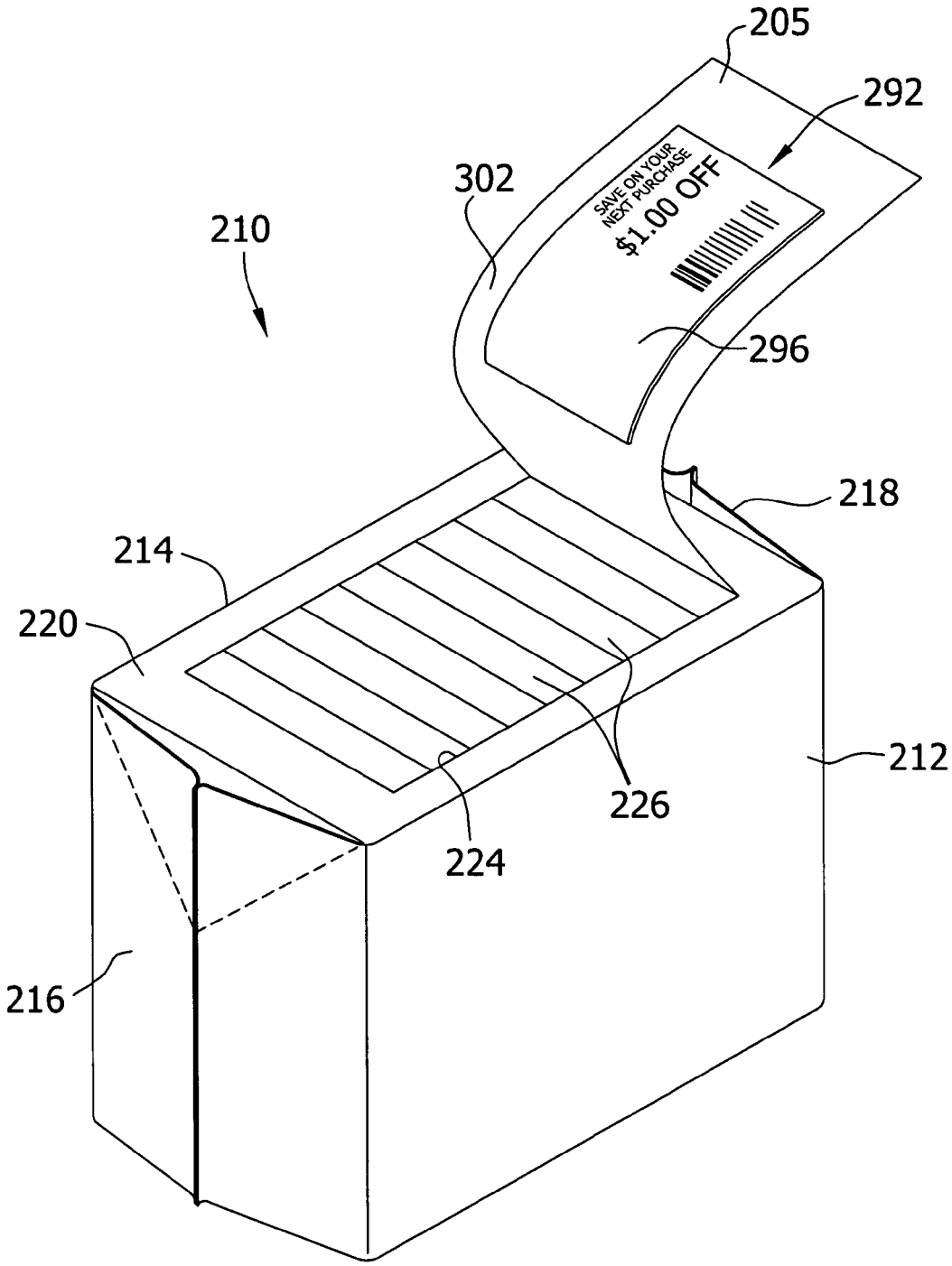
FIG. 22 shows a perspective view of a flexible package according to yet another alternative embodiment, with an opening device of the package partially detached therefrom and an article secured to the inner surface of the opening device.

In other embodiments the article 292 secured to the opening device 205 may comprise a relatively thin sheet or material web 296, such as of paper, plastic, film, non-woven web, woven web and the like with indicia applied thereto, such as is illustrated in FIG. 22. Examples of such articles 292 may include, without limitation, coupons, product descriptions, advertisements and promotional communications (e.g., sweepstakes game pieces, contest rules, and the like). The relatively thin sheet or web 296 may also comprise a sample material swatch. Alternatively, the sheet or material web 296 may be folded and secured to the opening device 205.

Figure 23:
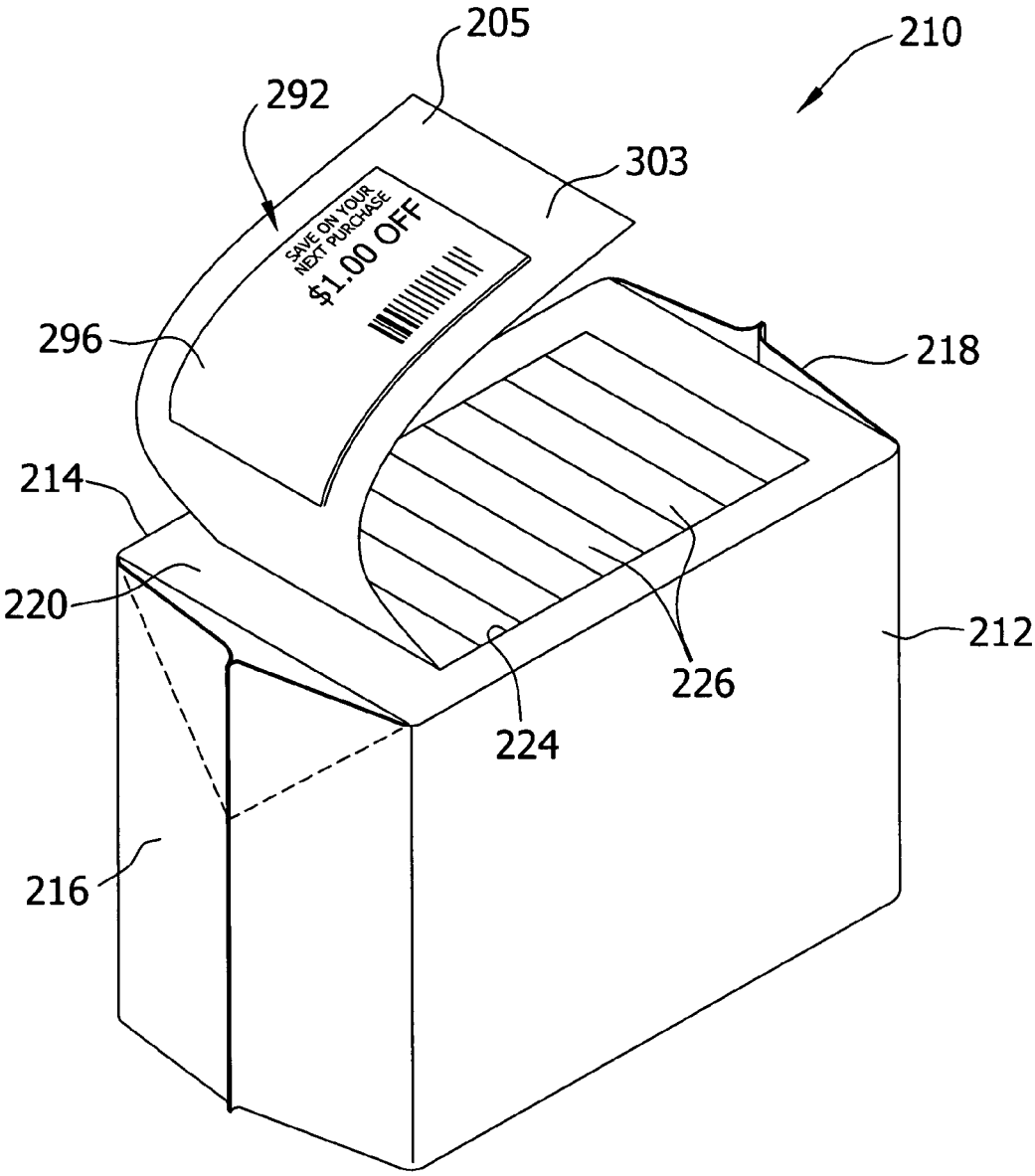
FIG. 23 shows a perspective view of a flexible package similar to that of FIG. 22 but with an article secured to the outer surface of the opening device.

The article 292 may be permanently secured to the opening device 205, i.e., so as to be inseparable from the opening device without damaging (e.g., tearing) the opening device, or it may be releasably secured to the opening device to permit intended removal of the article from the opening device. Any suitable conventional securement technique may be used to secure the article 292 to the opening device 205, such as, without limitation, adhesive bonding, pressure bonding, ultrasonic or thermal bonding, refastenable hook and loop fasteners, other mechanical fasteners and the like. It is also understood that the article 292 may be secured to the front side or outer surface 303 of the opening device 205 as illustrated in FIG. 23 without departing from the scope of this invention. It is also contemplated that the article 292 may be in part formed integrally with the opening device 205. For example, where the article comprises a pocket or pouch (e.g., such as the pocket or pouch 294 of disposable bags illustrated in FIG. 21) the opening device 205 may define one side of the pocket or pouch.

In each of the embodiments of FIGS. 20-23, the article 292 secured to the opening device 205 is suitably sized smaller in length and/or width, and more suitably in both length and width, than the opening device. For example, in one embodiment the article 292 may have a length that is at least about 10 percent shorter than the length of the opening device 205, more suitably at least about 15 percent shorter, and even more suitably at least about 20 percent shorter. The width of the article 292 may suitably be at least about 10 percent shorter than the width of the opening device 205, more suitably at least about 15 percent shorter, and even more suitably at least about 20 percent shorter.

It is understood that the percent difference in length between the article 292 and the length of the opening device 205 may be different from the percent difference in width between the article and the width of the opening device without departing from the scope of this invention. It is also understood that the article 292 may be shorter in length and/or narrower in width than as set forth above.

In a particularly suitable embodiment, the article 292 is positioned on the opening device 205 spaced inward from each of the peripheral edges of the opening device. It is understood, however, that the article 292 need not be centrally positioned on the opening device 205 to remain within the scope of this invention. For example, the article 292 may be spaced from each of the peripheral edges of the opening device 205 but be nearer to one end than the other, or nearer to one side than the other.

In another embodiment the article 292 may have a length that is no more than 50 percent of the length of the opening device 205 to which it is secured and is positioned generally on one-half of the length of the opening device. That is, the length of the opening device 205 is divided in half by a transverse (e.g., widthwise) centerline (e.g., either an imaginary line or an actual fold line (not shown) formed in the opening device) and the article 292 may be positioned on only one side of the transverse centerline. In another embodiment the article 292 may have a width that is no more than 50 percent of the width of the opening device 205 to which it is secured and is positioned generally on one-half of the width of the opening device as illustrated in FIG. 21. That is, the width of the opening device 205 is divided in half by a longitudinal (e.g., lengthwise) centerline (e.g., either an imaginary line or an actual fold line (not shown) formed in the opening device) and the article 292 may be positioned on only one side of the longitudinal centerline.

It is understood, however, that the article 292 secured to the opening device 205 may be substantially the same length and width as the opening device and remain within the scope of this invention.

It is also understood that the article 292 may be secured to any of the opening devices 5, 105 of the flexible packages 10, 110 illustrated in FIGS. 1-11 and 16-20 and described previously herein, and to any of the covering devices 6 of the flexible packages illustrated in FIGS. 12-15 and described previously herein.

Although the present invention has been described with reference to various embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A flexible package comprising:

a top surface, a bottom surface spaced from the top surface, and at least one side wall; the top surface and the bottom surface each being connected to the at least one side wall such that the top surface, the bottom surface and the at least one side wall together define an interior volume of the package for containing at least one article therein, said top surface having a length, a width, and a peripheral edge defined at least in part by the connection of the top surface to the at least one side wall;

an opening device attached to the top surface and being at least in part detachable from the top surface to provide access to the interior volume of the package, said opening device having a width at some point along the length of the opening device which is between about 40% and about 99% of the width of the top surface and a length at some point along the width of the opening device which is between about 40% and about 99% of the length of the top surface; and at least one drawstring for drawing in the at least one side wall of the package to selectively close access to the interior volume of the package following detachment of the opening device from the top surface of the package.

2. The flexible package set forth in claim 1 wherein the at least one drawstring is connected to the at least one side wall.

3. The flexible package set forth in claim 2 wherein the at least one side wall has a free edge spaced from the connection between the top surface of the package and the at least one side wall, the at least one drawstring being connected to the at least one side wall in spaced relationship with the top surface of the package.

4. The flexible package set forth in claim 3 wherein the at least one drawstring is connected to the at least one side wall generally adjacent the free edge of said at least one side wall.

5. The flexible package set forth in claim 2 wherein the at least one side wall comprises a front side wall, a back side wall in opposed relationship with the front side wall, a first side wall extending between the front and back side walls and a second side wall in opposed relationship with the first side wall and extending between the front and back side walls, wherein the front and back side walls, the first and second side walls, the bottom surface and the top surface together define the interior volume of the flexible package, the at least one drawstring being connected to at least one of a) the front and back side walls and b) the first and second side walls.

6. The flexible package set forth in claim 5 wherein the at least one drawstring is connected to the front and back side walls and the first and second side walls.

7. The flexible package set forth in claim 5 wherein the front and back side walls are respectively connected to the first and second side walls at least at the location at which the at least one drawstring is connected to said at least one of a) the front and back side walls and b) the first and second side walls.

8. The flexible package set forth in claim 1 wherein the package comprises a pair of drawstrings.

9. The flexible package set forth in claim 2 wherein the at least one drawstring is disposed at least in part within the at least one side wall.

10. A flexible package comprising a top surface, a bottom surface spaced from the top surface, and at least one side wall; the top surface and the bottom surface each being connected to the at least one side wall such that the top surface, the bottom surface and the at least one side wall together define an interior volume of the package for containing at least one article therein, said top surface having a length, a width, and a peripheral edge defined at least in part by the connection of the top surface to the at least one side wall, a portion of the at least one sidewall extending outward beyond the connection of the top surface to the at least one side wall and having a free edge spaced from said connection of the top surface to said at least one side wall;

an opening device attached to the top surface of the package and being at least in part detachable from the top surface to provide access to the interior volume of the package, said opening device having a width at some point along the length of the opening device which is between about 40% and about 99% of the width of the top surface and a length at some point along the width of the opening device which is between about 40% and about 99% of the length of the top surface; and a closure system operable on said portion of the at least one side wall to permit selective closing and opening of the package following detachment of the opening device from the top surface of the package.

11. The flexible package set forth in claim 10 wherein the closure system is connected to said portion of the at least one side wall at a location that is at least one of a) adjacent the free edge of said portion of the at least one sidewall and b) intermediate the free edge of said portion of the at least one side wall and the connection of the top surface to the at least one side wall.

12. The flexible package set forth in claim 10 wherein the closure system is operable on said portion of the at least one side wall to selectively configure said portion between an open configuration in which the free edge of said portion defines an opening for accessing the interior volume of the package through said top surface and a closed configuration in which said opening is substantially narrowed to inhibit the removal of contents from the package at said opening.

13. The flexible package set forth in claim 10 wherein the at least one side wall comprises a front side wall, a back side wall in opposed relationship with the front side wall, a first side wall extending between the front and back side walls and a second side wall in opposed relationship with the first side wall and extending between the front and back side walls, wherein the front and back side walls, the first and second side walls, the bottom surface and the top surface together define the interior volume of the flexible package, the top surface being connected to the front and back side walls and to the first and second side walls, a portion of at least one of a) each of the front and back side walls and b) each of the first and second side walls extending outward beyond the connection of the top surface to said front and back side walls and said first and second sidewalls and having a free edge spaced from said connection of the top surface to said front and back side walls and said first and second side walls.

14. The flexible package set forth in claim 13 wherein the closure system is connected to said portion of said at least one of a) each of the front and back side walls and b) each of the first and second side walls.

15. The flexible package set forth in claim 13 wherein a portion of each of the front and back side walls and each of the first and second side walls extends outward beyond the connection of the top surface to said front and back side walls and said first and second sidewalls and has a free edge spaced from said connection of the top surface to said front and back side walls and said first and second side walls, said portions of the front and back side walls and the first and second side walls being respectively connected to each other, the closure system being connected to each said portion of said front and back side walls and said first and second side walls.

* * * * *